US011535444B2

(12) United States Patent
Oguchi et al.

(10) Patent No.: US 11,535,444 B2
(45) Date of Patent: Dec. 27, 2022

(54) GLASS SLIDE SET, PACKAGING BOX FOR GLASS SLIDES, AND METHOD OF SETTING GLASS SLIDES

(71) Applicant: SYSMEX CORPORATION, Kobe (JP)

(72) Inventors: Kazuhiro Oguchi, Kobe (JP); Atsushi Ishikawa, Kobe (JP); Shogo Kubota, Kobe (JP); Seiya Shinabe, Kobe (JP)

(73) Assignee: SYSMEX CORPORATION, Kobe (JP)

( * ) Notice: Subject to any disclaimer, the term of this patent is extended or adjusted under 35 U.S.C. 154(b) by 720 days.

(21) Appl. No.: 16/008,093

(22) Filed: Jun. 14, 2018

(65) Prior Publication Data

US 2018/0362245 A1 Dec. 20, 2018

(30) Foreign Application Priority Data

Jun. 20, 2017 (JP) ..... JP2017-120114

(51) Int. Cl.

| | |
|---|---|
| ***B65D 83/00*** | (2006.01) |
| ***B65D 85/48*** | (2006.01) |
| ***B65D 25/00*** | (2006.01) |
| ***B65D 85/62*** | (2006.01) |
| *B65D 71/40* | (2006.01) |

(52) U.S. Cl.

CPC ..... *B65D 83/0005* (2013.01); *B65D 25/005* (2013.01); *B65D 85/48* (2013.01); *B65D 85/62* (2013.01); *B65D 71/40* (2013.01)

(58) Field of Classification Search

CPC .. B65D 83/0005; B65D 25/005; B65D 85/48; B65D 85/62; B65D 71/40; B65D 5/72; B65D 5/721

USPC ..... 206/817

See application file for complete search history.

(56) References Cited

U.S. PATENT DOCUMENTS 1,539,676 A * 5/1925 Labombarde ..... B65D 5/72 229/152
2,474,166 A * 6/1949 Rumsey, Jr. ..... B65D 5/38 206/525
4,621,935 A * 11/1986 Sussman ..... A45D 40/02 401/176
4,838,423 A * 6/1989 Lerner ..... B65D 85/48 206/454

(Continued)

FOREIGN PATENT DOCUMENTS

GB 2004-815836 * 11/2004
GB 2401856 A 11/2004

(Continued)

OTHER PUBLICATIONS

Office Action (CNOA) dated Jan. 12, 2021 in a counterpart Chinese patent application.

(Continued)

*Primary Examiner* — Javier A Pagan

(74) *Attorney, Agent, or Firm* — Metrolex IP Law Group, PLLC

(57) ABSTRACT

A glass slide set according to one or more embodiments may include: a stack of glass slides; and a packaging box that houses the stack. The packaging box may include: an exit opening through which the stack exits; and a push opening through which the stack is pushed, so that the stack exits through the exit opening.

17 Claims, 15 Drawing Sheets

(56) References Cited

U.S. PATENT DOCUMENTS 6,270,006 B1 * 8/2001 Bright ..... B65D 5/721
229/122

FOREIGN PATENT DOCUMENTS

| | | | |
|---|---|---|---|
| GB | 2420113 | A | 5/2006 |
| JP | 2009-145261 | A | 7/2009 |

OTHER PUBLICATIONS

Chinese Office Action dated Nov. 25, 2019 in a counterpart Chinese patent application.
Chinese Office Action dated Jul. 23, 2021 in a counterpart Chinese patent application, with English translation.
Office Action dated Sep. 30, 2020 in a counterpart Chinese patent application.

* cited by examiner

GLASS SLIDE SET, PACKAGING BOX FOR GLASS SLIDES, AND METHOD OF SETTING GLASS SLIDES

CROSS REFERENCE TO RELATED APPLICATIONS

This application claims priority from prior Japanese Patent Application No. 2017-120114 filed with the Japan Patent Office on Jun. 20, 2017, the entire contents of which are incorporated herein by reference.

BACKGROUND

The disclosure relates a glass slide set, a packaging box for glass slides, and a method of setting glass slides.

Japanese Patent Application Publication No. 2009-145261 (Patent Document 1) discloses a smear preparing apparatus for preparing smears of blood samples using glass slides. The smear preparing apparatus includes a glass slide feeding unit that holds glass slides and feeds them to a slide transportation unit. The smear preparing apparatus performs various processes automatically such as applying blood samples to glass slides fed from the glass slide feeding unit one by one and staining those samples.

Glass slides used for a smear preparing apparatus are commonly sold in a state as illustrated in FIG. 27 where the glass slides are housed in a paper packaging box 900. The user takes out glass slides 901 pieces by pieces by hand from the opened packaging box 900 and transfers them to a glass slide feeding unit 902 of the smear preparing apparatus. Meanwhile, the smear surface of a glass slide is used to smear blood for testing. Hence, when the glass slides 901 are transferred, care needs to be taken such that the hand does not touch the smear surfaces of the glass slides 901. In addition, since glass slides are made of glass, extreme care needs to be taken such that the glass slides 901 are not subjected to a shock. Thus, the work to transfer the glass slides 901 is a considerable burden to the user.

SUMMARY

A glass slide set according to one or more embodiments may include: a stack of glass slides; and a packaging box that houses the stack. The packaging box may include: an exit opening through which the stack exits; and a push opening through which the stack is pushed, so that the stack exits through the exit opening.

A packaging box according to one or more embodiments may house a stack of glass slides. The packaging box may include: an exit opening through which the stack exits; and a push opening through which the stack is pushed so that the stack exits through the exit opening.

A method of setting glass slides according to one or more embodiments may include: placing an exit opening, which is formed in a packaging box that houses a stack of glass slides, so as to face a glass slide setting part of a smear preparing apparatus; pushing the stack in the packaging box through a push opening that faces a surface of the stack different from a surface of the stack that the exit opening faces; and moving the pushed stack from the packaging box to the glass slide setting part through the exit opening.

A glass slide set according to one or more embodiments may include: a stack of glass slides; and a packaging box that houses the stack. The packaging box may include an exit opening through which the stack exits such that a short-side side surface of the stack exits first.

A glass slide set according to one or more embodiments may include: a stack of glass slides; and a packaging box that houses the stack. The packaging box may include: an exit opening through which the stack exits; and a push member that is disposed on an opposite side of the stack from the exit opening and capable of moving the stack toward the exit opening.

DETAILED DESCRIPTION

Figure 1:
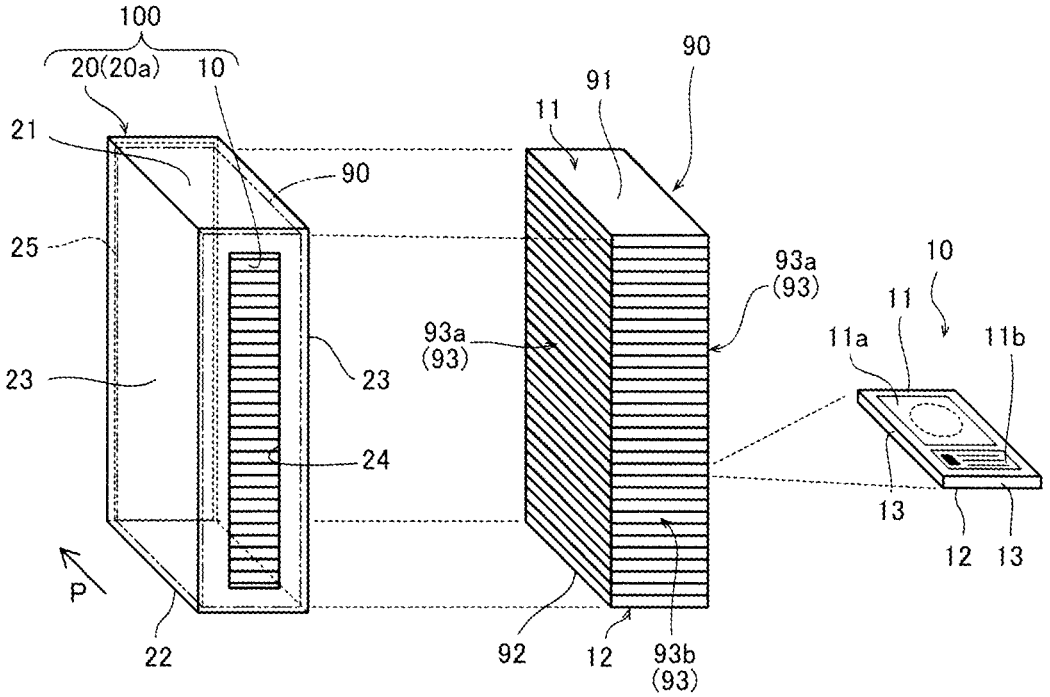
FIG. 1 is a schematic diagram illustrating an overview of a glass slide set according to an embodiment.

One or more aspects are directed to making the transfer work easy even in the case of transferring glass slides from a simple packaging box.

A glass slide set according to a first aspect includes: a stack 90 of glass slides 10; and a packaging box 20 that houses the stack 90, in which the packaging box 20 includes an exit opening 25 through which the stack 90 exits such that a side surface 93 of the stack 90 comes first and a push opening 24 through which the stack 90 is pushed so that the stack 90 exits out through the exit opening 25.

Note that the glass slide 10 has generally a rectangular plate shape, and the stack 90 of glass slides has an upper surface, lower surface, and side surfaces. In this specification, the upper surface of the stack 90 means a surface where the smear surface among the surfaces of a stacked outermost glass slide is placed. The lower surface of the stack 90 means a surface where the opposite surface opposite from the smear surface among the surfaces of a stacked outermost glass slide is placed. The side surfaces of the stack 90 mean surfaces constituted of end surfaces orthogonal to the smear surfaces and the opposite surfaces, among the surfaces of the stacked glass slides. The push opening 24 is an opening through which the stack is pushed so that the stack exits out through the exit opening, but the push opening 24 may be a part that is closed with a seal or a part of a box body in the initial state and removed by the user. The exit opening 25 is an opening through which the stack exits the box body, but the exit opening 25 may be a part that is closed with a seal or a part of a box body in the initial state and removed by the user. One of the surfaces means one of an upper surface, a lower surface, and side surfaces of the stack 90.

In the glass slide set according to a first aspect, as described above, the packaging box 20 includes an exit opening 25 through which the stack 90 exits such that a side surface 93 of the stack 90 comes first and a push opening 24 through which the stack 90 is pushed so that the stack 90 exits out through the exit opening 25. This allows the user to take out the stack 90 through the exit opening 25 just by pushing out one of the surfaces of the stack 90 of the glass slides 10 in the packaging box 20 through the push opening 24 toward the exit opening 25. Thus, when the user transfers the glass slides 10 from the packaging box 20 to a smear preparing apparatus, the user can transfer the glass slides 10 easily just by pushing out a portion of the glass slides 10, which is one of the surfaces of the stack 90, without touching the smear surface 11 of a glass slide 10. In addition, since there is no need to hold the glass slides 10 with the hands to take out the glass slides 10, but it is possible to send out the glass slides 10 from the inside of the packaging box 20, it is also possible to reduce the possibility of dropping the glass slides 10 or exerting an impact on the glass slides 10 when transferring them. In addition, since the packaging box 20 only needs to have the push opening 24 and the exit opening 25, a simple structure can be employed for the packaging box 20. As described above, it is possible to make the transfer work easy even in the case of transferring glass slides from a simple packaging box.

In the glass slide set according to the foregoing first aspect, it may be preferable that the packaging box 20 have the push opening 24 in a side surface 93 of the stack 90 different from a side surface 93 on which the exit opening 25 is formed. This configuration allows the user to push out the stack 90 easily and makes it possible to form the packaging box 20 in a small size, compared with a configuration in which both the exit opening 25 and the push opening 24 are formed on the same side surface 93 side of the stack 90.

In the glass slide set according to the foregoing first aspect, it may be preferable that the packaging box 20 have the push opening 24 on an opposite side of the stack 90 from the exit opening 25. With this configuration, since the push opening 24 and the exit opening 25 face each other, the user can easily take out the stack 90 through the exit opening 25 just by pushing out a side surface 93 of the stack 90 toward the opposite exit opening 25 side through the push opening 24.

In the glass slide set according to the foregoing first aspect, it may be preferable that the packaging box 20 include a box body 20*a* that covers at least a part of an upper surface 91, a lower surface 92, and side surfaces 93 of the stack 90. This configuration allows the box body 20*a* to house the stack 90 more stably.

In the glass slide set according to the foregoing first aspect, it may be preferable that the packaging box 20 include a push member 40 that is disposed on an opposite side of the stack 90 from the exit opening 25 and capable of moving the housed stack 90 toward the exit opening 25. This configuration allows the user to push the push member 40 through the push opening 24 to push out the stack 90 via the push member 40 toward the exit opening 25. Hence, the user can transfer the glass slides 10 easily without touching them.

it may be preferable that the packaging box 20 include a box body 20*a* that covers at least a part of an upper surface 91, a lower surface 92, and side surfaces 93 of the stack 90, and that the push member 40 be separate from the box body 20*a* and have an outside shape larger than the push opening 24 in a plane where the push opening 24 is formed. With this configuration, the area of the push member 40 can be large, and this allows the user to apply force to a wide area of the stack 90. This reduces displacement of each of the glass slides 10 in the stack 90 when the glass slides 10 are moved from the box body 20*a*, and thus the glass slides 10 inside the box body 20*a* can be moved out together. In addition, even in the case of a large push opening 24, the push member 40 covers the push opening 24, preventing the glass slides 10 from protruding from the push opening 24.

In the configuration including push member 40, it may be preferable that the push member 40 include a first part 41 that is disposed on the opposite side of the stack 90 from the exit opening 25 and a second part 42 that is connected to the first part 41 and cover at least a part of an upper surface 91, a lower surface 92, or side surfaces 93*a* adjacent to a side surface 93*b* on the first part 41 side, of the stack 90. With this configuration, the second part 42 improves the rigidity of the push member 40, compared with a push member 40 having only the first part 41, which reduces the deflection of the push member 40 which may occur when the stack 90 is pushed out and makes it easy to push out the stack 90. In addition, since the second part 42 is disposed between the packaging box 20 and the stack 90, the second part 42 functions as a guide when the push member 40 is moved inside the packaging box 20, making it possible to move the push member 40 smoothly.

In the configuration in which the push member 40 includes the first part 41 and the second part 42, it may be preferable that the second part 42 have an upper part 43 extending along the upper surface 91 of the stack 90 and a lower part 44 extending along the lower surface 92 of the stack 90, and that the push member 40 hold the stack 90 between the upper part 43 and the lower part 44. This configuration allows the stack 90 to be moved toward the exit opening 25 in the state where the push member 40 holds the stack 90 so as to pinch it with the upper part 43 and the lower part 44 in the up-down direction, making it possible to take out the glass slides 10 in the packaging box 20 together more positively.

In the configuration in which the push member 40 includes the first part 41 and the second part 42, it may be preferable that the second part 42 have a pair of side parts 45 extending along a pair of the side surfaces 93*a* adjacent to the side surface 93*b* of the stack 90 on the first part 41 side, and that the push member 40 hold the stack 90 between the pair of side parts 45. This configuration allows the stack 90 to be moved toward the exit opening 25 in the state where the push member 40 holds the stack 90 so as to pinch it with the pair of side parts 45 in the right-left direction, making it possible to take out the glass slides 10 in the packaging box 20 together more positively. In addition, in the case where the number of stacked glass slides 10 is large, the height of the side surfaces 93 of the stack 90 is large, and the height of the first part 41 is likely to be large. However, the side parts 45 extending along the side surfaces 93*a* function as reinforcement of the first part 41 and reduce the deflection of the push member 40 when the push member 40 is pressed.

It may be preferable that end portions of the side parts 45 on the exit opening 25 side be inclined to get closer to the first part 41 as extending toward the lower surface of 92 the stack 90. Here, in the case of transferring the stack 90 from the inside of the packaging box 20 to the glass slide setting part 200 of the smear preparing apparatus, pushing the push member 40 can push out the stack 90 into the glass slide setting part 200, for example, until the upper end portions of the side parts 45 come into contact with the glass slide setting part 200. Even after the upper end portions of the side parts 45 come into contact with the glass slide setting part 200, the lower end portions of the inclined side parts 45 remain in no contact. Hence, the user can further push the lower part of the push member 40 by pushing a portion of the first part 41, close to the lower surface 92 of the stack 90, until the inclined end portions of the side parts 45 come into contact with the glass slide setting part 200, and thus the user can push out the stack 90 into the glass slide setting part 200. By doing so, the user can move most part of the stack 90 easily into the glass slide setting part 200 just by pushing the push member 40.

In the configuration in which the push member 40 includes the first part 41 and the second part 42, it may be preferable that the second part 42 be annularly continuous so as to surround the stack 90 along the upper surface 91, the lower surface 92, a pair of the side surfaces 93*a* adjacent to the side surface 93*b* on the first part 41 side, of the stack 90, and that the stack 90 be placed to fit in a recessed part 46 formed of the first part 41 and the annular second part 42. With this configuration, the end portion of the stack 90 on the first part 41 side is placed inside the recessed part 46 of the push member 40 and held stably. This effectively reduces displacement of each of the glass slides 10 when the stack 90 exits from the packaging box 20, and thus the glass slides 10 inside the packaging box 20 can be moved out together more positively.

In the configuration including the push member 40, it may be preferable that the packaging box 20 include a box body 20*a* that covers at least a part of an upper surface 91, a lower surface 92, and side surfaces 93 of the stack 90, and that the push member 40 cover, inside the box body 20*a*, substantially the entire side surface 93 of the stack 90 on the opposite side from the exit opening 25. With this configuration, the push member 40 makes it possible to push substantially the whole of the side surface 93*b* of the stack 90 on the opposite side from the exit opening 25 to move the stack 90, and thus this also makes it possible to take out the glass slides 10 in the box body 20*a* together more easily and positively.

In the glass slide set according to the foregoing first aspect, it may be preferable that the push opening 24 face one short-side side surface 93*b* of the stack 90. With this configuration, it is possible to push out a short-side side surface 93*b* of the stack 90 toward the exit opening 25 to take it out from the packaging box 20. In this case, the moving distance by which the glass slides 10 need to be pushed out is longer than the case of being pushed out in the direction along the short sides. However, this makes it possible to reduce the possibility of the user mistakenly dropping the glass slides 10 from the exit opening 25, according to the long moving distance.

It may be preferable that the packaging box 20 include a box body 20*a* that covers at least a part of an upper surface 91, a lower surface 92, and side surfaces 93 of the stack 90, a side surface portion 23 of the box body 20*a* faces three surfaces of the stack 90, which are a pair of long-side side surfaces 93*a* and one of a pair of short-side side surfaces 93*b*, and that the exit opening 25 face the other one of the pair of short-side side surfaces 93*b* and be entirely open in a plane in which the side surface portion 23 does not extends. With this configuration, the exit opening 25 can be formed by designing one side surface of the box body 20*a* in a rectangular parallelepiped shape to be an opening. Thus, it is possible to form the simple box body 20*a* that is capable of housing the stack 90 of the glass slides 10 as small as possible, and it is also possible to take out the stack 90 easily from the exit opening 25, which is open at one side surface of the box body 20*a*.

In the glass slide set according to the foregoing first aspect, it may be preferable that the packaging box 20 include a box body 20*a* that covers at least a part of an upper surface 91, a lower surface 92, and side surfaces 93 of the stack 90, and that the box body 20*a* include an engagement portion 26 that protrudes from an end of the box body 20*a* on the exit opening 25 side and be engaged with a glass slide setting part 200 of a smear preparing apparatus. With this configuration, when the user transfers the glass slides 10, the user can adjust the position of the packaging box 20 easily by engaging the engagement portion 26 with the glass slide setting part 200. This makes the transfer work much easier.

It may be preferable that the engagement portion 26 be formed at a lower surface portion 22 of the box body 20*a* or between the lower surface portion 22 and the stack 90 and have a plate shape extending along a lower surface 92 of the stack 90. In other words, the engagement portion 26 may be formed as a part of the lower surface portion 22 of the box body 20*a*, or the engagement portion 26 may be a separate plate member disposed between the lower surface portion 22 and the stack 90. This configuration allows the user to push out the stack 90 to the glass slide setting part 200 in the state where the engagement portion 26 is engaged so as to go over the setting surface of the glass slide setting part 200. This reduces the possibility of the glass slides 10 being caught with a gap which might be made between the glass slide setting part 200 and the box body 20*a*, and thus makes it possible to transfer the glass slides 10 smoothly.

In the glass slide set according to the foregoing first aspect, it may be preferable that the packaging box 20 have the exit opening 25 substantially as large as a side surface 93 of the stack 90 on the exit opening 25 side. With this configuration, the exit opening 25 can have a minimum size that allows the stack 90 to pass therethrough, which reduces displacement of each glass slide 10 when the glass slides 10 are moved out.

In the glass slide set according to the foregoing first aspect, it may be preferable that in a stacking direction of the stack 90, a width of the push opening 24 be smaller than a width of a side surface 93 of the stack 90 on the push opening 24 side. This configuration prohibits each of the glass slides 10 from passing through the push opening 24 and thus positively prevents the glass slides 10 from protruding from the push opening 24.

In the glass slide set according to the foregoing first aspect, it may be preferable that the packaging box 20 include a box body 20*a* that covers at least a part of an upper surface 91, a lower surface 92, and side surfaces 93 of the stack 90, and that the stack 90 be placed such that a distal end portion of the stack 90 in a direction from a side opposite to the exit opening 25 toward the exit opening 25 is exposed from the exit opening 25. With this configuration, when transferring the glass slides 10, the user can move out the stack 90 to transfer the glass slides 10 in the state where the distal end portions of the glass slides 10 exposed from the exit opening 25 are partially inserted into the inside of the glass slide setting part 200. This, in turn, makes it possible to transfer the glass slides 10 easily without the distal end portions of the glass slides 10 being caught.

In the glass slide set according to the foregoing first aspect, it may be preferable that the packaging box 20 include a box body 20*a* that covers at least a part of an upper surface 91, a lower surface 92, and side surfaces 93 of the stack 90, and that in a direction P from an opposite side from the exit opening 25 toward the exit opening 25, a length of a side surface portion 23 of the box body 20*a* be smaller than a length of the stack 90. With this configuration, when transferring the glass slides 10, the user can move out the stack 90 to transfer the glass slides 10 in the state where the distal end portions of the glass slides 10 exposed from the exit opening 25 are partially inserted into the inside of the glass slide setting part 200. As a result, it is possible to transfer the glass slides 10 easily without the distal end portions of the glass slides 10 being caught.

In the glass slide set according to the foregoing first aspect, it may be preferable that the packaging box 20 include a box body 20*a* that covers at least a part of an upper surface 91, a lower surface 92, and side surfaces 93 of the stack 90 and a cover member 20*b* that is separate from the box body 20*a* and covers a surface of the stack 90 on the exit opening 25 side. This configuration prevents the glass slides 10 from coming out through the exit opening 25 using the cover member 20*b* at the time other than when the glass slides 10 are transferred. The user can take out the glass slides 10 from the exit opening 25 easily by removing the cover member 20*b* before transferring the glass slides 10.

It may be preferable that the packaging box 20 have the box body 20*a* and the cover member 20*b* that are formed integrally such that the box body 20*a* and the cover member 20*b* are separable. With this configuration, the glass slides 10 can be held firmly with the box body 20*a* and the cover member 20*b*, and the cover member 20*b* can be removed by the user when the glass slides 10 are moved out.

In the glass slide set according to the foregoing first aspect, it may be preferable that the packaging box 20 be made of paper. This configuration provides a simple packaging box 20 the costs of which is low and which is less likely to affect the environmental load, compared with the case of using, for example, a dedicated resin container. Even in that case, it is easy to transfer the glass slides.

A packaging box for glass slides according to a second aspect is a packaging box 20 that houses a stack 90 of glass slides 10 including: an exit opening 25 through which the stack 90 exits; and a push opening 24 through which the stack 90 is pushed so that the stack 90 exits out through the exit opening 25.

As described above, a packaging box for glass slides according to the second aspect includes: an exit opening 25 through which the stack 90 exits; and a push opening 24 through which the stack 90 is pushed so that the stack 90 exits out through the exit opening 25. With this configuration, the user can take out the stack 90 through the exit opening 25 just by pushing the stack 90 of the glass slides 10 in the packaging box 20 toward the exit opening 25 through the push opening 24. Accordingly, when the user transfers the glass slides 10 from the packaging box 20 to the smear preparing apparatus, the user can transfer them without touching the smear surface 11 of a glass slide 10 just by pushing one of the surfaces. In addition, since there is no need to hold the glass slides 10 with the hands to take out the glass slides 10, but it is possible to send out the glass slides 10 from the inside of the packaging box 20, it is also possible to reduce the possibility of dropping the glass slides 10 or exerting an impact on the glass slides 10 when transferring them. Even in that case, since the packaging box 20 only needs to have the push opening 24 and the exit opening 25, a simple structure can be employed for the packaging box 20. As described above, it is possible to make the transfer work easy even in the case of transferring glass slides from a simple packaging box.

A method of setting glass slides according to a third aspect includes: placing an exit opening 25 that is formed in a packaging box 20 to house a stack 90 of glass slides 10, and through which the stack 90 exits, such that the exit opening 25 faces a glass slide setting part 200 of a smear preparing apparatus; pushing out the stack 90 inside the packaging box 20 through a push opening 24 that faces a surface of the stack 90 different from a surface that the exit opening 25 faces; and moving the pushed-out stack 90 from the packaging box 20 to the glass slide setting part 200 through the exit opening 25. Note that pushing out the stack means moving the stack by exerting force on it. It is a broad concept including not only, for example, the case where the user pushes out the stack from the opposite side from the exit opening toward the exit opening but also the case where the user pulls the stack from the exit opening side toward the exit opening.

As described above, the method of setting glass slides according to the third aspect includes: pushing out the stack 90 inside the packaging box 20 through a push opening 24 that faces a surface of the stack 90 different from a surface that the exit opening 25 faces as; and moving the pushed-out stack 90 from the packaging box 20 to the glass slide setting part 200 through the exit opening 25. With this, the user can take out the stack 90 from the exit opening 25 just by pushing out one of the surfaces of the stack 90 of the glass slides 10 in the packaging box 20 through the push opening 24 toward the exit opening 25. Accordingly, when the user transfers the glass slides 10 from the packaging box 20 to the smear preparing apparatus, the user can transfer them easily without touching the smear surface 11 of a glass slide 10 just by pushing one of the surfaces. In addition, since there is no need to hold the glass slides 10 with the hands to take out the glass slides 10, but it is possible to send out the glass slides 10 from the inside of the packaging box 20, it is also possible to reduce the possibility of dropping the glass slides 10 or exerting an impact on the glass slides 10 when transferring them. Even in that case, since the packaging box 20 only needs to have the push opening 24 and the exit opening 25, a simple structure can be employed for the packaging box 20. As described above, it is possible to make the transfer work easy even in the case of transferring glass slides from a simple packaging box.

A glass slide set according to a fourth aspect includes: a stack 90 of glass slides 10; and a packaging box 20 that houses the stack 90, in which the packaging box 20 has an exit opening 25 through which the stack 90 exits such that a short-side side surface 93*b* of the stack 90 comes first.

In the glass slide set according to the fourth aspect, as described above, the packaging box 20 has an exit opening 25 through which the stack 90 exits such that the short-side side surface 93*b* of the stack 90 comes first. With this, the user can move the stack 90 of the glass slides 10 from the inside of the packaging box 20 toward the exit opening 25, for example, by inclining the packaging box 20, and then take out the stack 90 from the exit opening 25. Thus, when the user transfers glass slides 10 from the packaging box 20 to the smear preparing apparatus, the user can transfer the glass slides 10 easily just by sliding the stack 90 toward the exit opening 25 without touching the smear surface 11 of a glass slide 10. In addition, since what needs to be done is only move the stack 90 from the inside of the packaging box 20 in the longitudinal direction, the glass slides 10 can be transferred with the stack 90 kept stable unlike the case of moving the stack 90 in the lateral direction, which also reduces the possibility of dropping the glass slides 10 or exerting an impact on the glass slides 10. Even in that case, what needs to be done is just to form an exit opening 25 in the packaging box 20, and thus a simple structure can be employed. As described above, it is possible to make the transfer work easy even in the case of transferring glass slides from a simple packaging box.

A glass slide set according to a fifth aspect includes: a stack 90 of glass slides 10; and a packaging box 20 that houses the stack 90, in which the packaging box 20 includes an exit opening 25 through which the stack 90 exits and a push member 40 that is disposed on an opposite side of the stack 90 from the exit opening 25 and capable of moving the stack 90 toward the exit opening 25.

In the glass slide set according to the fifth aspect, as described above, the packaging box 20 includes an exit opening 25 through which the stack 90 exits and a push member 40 that is disposed on an opposite side of the stack 90 from the exit opening 25 and capable of moving the stack 90 toward the exit opening 25. With this, the user can move the stack 90 of the glass slides 10 together with the push member 40 via the push member 40 from the inside of the packaging box 20 toward the exit opening 25 and take out the stack 90 from the exit opening 25. Thus, when the user transfers glass slides 10 from the packaging box 20 to a smear preparing apparatus, the user can transfer the stack 90 easily without touching the smear surface 11 of a glass slide 10. In addition, since there is no need to hold the glass slides 10 with the hands to take them out, but it is possible to send out the glass slides 10 from the inside of the packaging box 20, it is also possible to reduce the possibility of dropping the glass slides 10 or exerting an impact on the glass slides 10 when transferring them. Even in that case, since the packaging box 20 only needs to have the exit opening 25 and the push member 40, a simple structure can be employed for the packaging box 20. As described above, it is possible to make the transfer work easy even in the case of transferring glass slides from a simple packaging box.

In the glass slide set according to the foregoing fifth aspect, it may be preferable that the push member 40 include a first part 41 that is disposed on the opposite side of the stack 90 from the exit opening 25 and a second part 42 that is connected to the first part 41 and covers at least a part of an upper surface 91, a lower surface 92, or side surfaces 93*a* adjacent to a side surface 93*b* on the first part 41 side, of the stack 90. With this configuration, the second part 42 improves the rigidity of the push member 40, compared with a push member 40 having only the first part 41, which reduces the deflection of the push member 40 which may occur when the stack 90 is pushed out and makes it easy to push out the stack 90. In addition, since the second part 42 is disposed between the packaging box 20 and the stack 90, the second part 42 functions as a guide when the push member 40 is moved inside the packaging box 20, making it possible to move the push member 40 smoothly.

It may be preferable that the second part 42 have an upper part 43 extending along the upper surface 91 of the stack 90 and a lower part 44 extending along the lower surface 92 of the stack 90, and that the push member 40 hold the stack 90 between the upper part 43 and the lower part 44. This configuration allows the stack 90 to be moved toward the exit opening 25 in the state where the push member 40 holds the stack 90 so as to pinch it with the upper part 43 and the lower part 44 in the up-down direction, making it possible to take out the glass slides 10 in the packaging box 20 together more positively.

In the configuration in which the push member 40 includes the first part 41 and the second part 42, it may be preferable that the second part 42 have a pair of side parts 45 extending along a pair of the side surfaces 93*a* adjacent to the side surface 93*b* of the stack 90 on the first part 41 side, and that the push member 40 hold the stack 90 between the pair of side parts 45. This configuration allows the stack 90 to be moved toward the exit opening 25 in the state where the push member 40 holds the stack 90 so as to pinch it with the pair of side parts 45 in the right-left direction, making it possible to take out the glass slides 10 in the packaging box 20 together more positively. In addition, in the case where the number of stacked glass slides 10 is large, the height of the side surfaces 93 of the stack 90 is large, and the height of the first part 41 is likely to be large. However, the side parts 45 extending along the side surfaces 93*a* function as reinforcement of the first part 41 and reduce the deflection of the push member 40 when the push member 40 is pressed.

It may be preferable that end portions of the side parts 45 on the exit opening 25 side be inclined to get closer to the first part 41 as extending toward the lower surface 92 of the stack 90. Here, in the case of transferring the stack 90 from the inside of the packaging box 20 to the glass slide setting part 200 of the smear preparing apparatus, pushing the push member 40 can push out the stack 90 into the glass slide setting part 200, for example, until the upper end portions of the side parts 45 come into contact with the glass slide setting part 200. Even after the upper end portions of the side parts 45 come into contact with the glass slide setting part 200, the lower end portions of the inclined side parts 45 remain in no contact. Hence, the user can further push the lower part of the push member 40 by pushing a portion of the first part 41, close to the lower surface 92 of the stack 90, until the inclined end portions of the side parts 45 come into contact with the glass slide setting part 200, and thus the user can push out the stack 90 into the glass slide setting part 200. By doing so, the user can move most of the stack 90 easily into the glass slide setting part 200 just by pushing the push member 40.

It is possible to make the transfer work easy even in the case of transferring glass slides from a simple packaging box.

Hereinafter, embodiments are explained with reference to drawings.

First Embodiment

Overview of Glass Slide Set and Packaging Box

With reference to FIG. 1, the overview of a glass slide set 100 and a packaging box 20 according to a first embodiment is described.

A glass slide set 100 includes a stack 90 of glass slides 10 and the packaging box 20 that houses or accommodates the stack 90. The glass slide set 100 is provided with the glass slides 10 housed in the packaging box 20, and the user takes out the glass slides 10 from the packaging box 20. The packaging box 20 is a packaging box for housing the stack 90 of the glass slides 10. The packaging box 20 is formed as a packaging box for glass slides that has a structure suitable for housing glass slides 10.

The glass slide 10 is a glass plate to which a specimen is placed or smeared for preparing a smear used for observation of the specimen using an optical microscope. The shape and dimensions of the glass slide 10 are not limited to specific ones, but the shapes and dimensions conforming to standards such as JIS (Japanese Industrial Standards) are generally used. Specifically, the glass slide 10 has a rectangular plate shape, the length of long sides is about 76 mm, and the length of short sides is about 26 mm. The thickness of the glass slide 10 is larger than or equal to about 0.9 mm and smaller than or equal to about 1.2 mm.

The glass slide 10 has a smear surface 11, which is one surface where a specimen is placed, an opposite surface 12, which is the other surface opposite to the smear surface 11, and end surfaces 13, which are outer peripheral surfaces. The smear surface 11 is provided with a smear area 11*a*, where a specimen is placed, and the smear surface 11 may also be provided with a print area 11*b* for printing information to identify the specimen. Examples of specimens include liquid such as blood and urine, and non-liquid such as tissue pieces and cells. The specimen is, for example, blood.

As an example, in the case of preparing a smear of a blood specimen, a blood specimen is dropped on the smear area 11*a* of the smear surface 11, and then the dropped specimen is smeared on the smear area 11*a*. In addition, information is written into the print area 11*b*. The smeared specimen on the smear surface 11 is stained with various reagents such as stain liquid, then cleaned, and after that, dried. With these processes, a blood smear suitable for microscopic observation is prepared. A series of processes for preparing smears is automated using a smear preparing apparatus. When used in the smear preparing apparatus, the glass slides 10 are moved from the packaging box 20 by the user and transferred to a specified glass slide setting part 200 (see FIG. 10) of the smear preparing apparatus. The set glass slides 10 are conveyed by the smear preparing apparatus one by one and subjected to the various processes described above.

The packaging box 20 of a first embodiment is formed such that when the user transfers glass slides 10 into an apparatus such as the smear preparing apparatus in which the glass slides 10 are used, the user can easily transfer the glass slides 10.

The packaging box 20 houses the stack 90, which is glass slides 10 stacked in the thickness direction. The number of stacked glass slides 10 is not limited to specific numbers. For example, the number is 100. The stack 90, which is glass slides 10 stacked in the thickness direction, has a rectangular parallelepiped shape. Thus, the packaging box 20 is formed in a box shape so that the packaging box 20 can have an internal space capable of housing the rectangular parallelepiped stack 90. In order to avoid the packaging box 20 becoming unnecessarily large, it is preferable that the packaging box 20 have a rectangular parallelepiped shape that reflects the shape of the stack 90 and is larger than the stack 90.

Here, description is provided for the stack 90. The stack 90 has an upper surface 91, a lower surface 92, and side surfaces 93. When the glass slides 10 are transferred into an apparatus, the glass slides 10 are generally placed with the smear surfaces 11 facing upward. Thus, the upper surface 91, lower surface 92, and side surfaces 93 are defined following the general usage. It is assumed that in the stack 90, glass slides 10 are stacked being oriented in the same direction. In the stacking direction of the glass slides 10, the smear surface 11 of the outermost glass slide 10 on one side is exposed, and the opposite surface 12 of the outermost glass slide 10 on the other side is exposed. The upper surface 91 of the stack 90 is a surface where the smear surface 11 of the stacked outermost glass slide 10 is placed. The lower surface 92 of the stack 90 is a surface where the opposite surface 12 side of the stacked outermost glass slide 10 is placed. The side surfaces 93 of the stack 90 are constituted of the end surfaces 13 of the stacked glass slides 10. The side surfaces 93 includes a pair of long-side side surfaces 93*a* constituted of the long sides of the glass slides 10 and a pair of short-side side surfaces 93 constituted of the short sides of the glass slides 10.

In an example illustrated in FIG. 1, the packaging box 20 includes an upper surface portion 21, which faces the upper surface 91 of the stack 90 of the stacked glass slides 10, a lower surface portion 22, which faces the lower surface 92 of the stack 90, and side surface portions 23, which face the side surfaces 93 of the stack 90.

The upper surface portion 21 of the packaging box 20 is formed to cover the upper surface 91 of the stack 90. The lower surface portion 22 is formed to cover the lower surface 92 of the stack 90. The side surface portions 23 are formed to cover one of the side surfaces 93 of the stack 90. The side surface portions 23 are disposed to include opposed two surfaces, three surfaces, or all the four surfaces of the four side surfaces 93 of the stack 90. For example, the upper surface portion 21, lower surface portion 22, and side surface portions 23 each have a flat plate shape formed along the opposing surface of the stack 90. The inner surfaces of the upper surface portion 21, lower surface portion 22, and side surface portions 23 may have flat shapes formed along the surfaces of the stack 90, and the outer surfaces thereof may have shapes formed not along the surfaces of the stack 90. The upper surface portion 21, lower surface portion 22, and side surface portions 23 each may have a shape that does not cover all the opposing surface of the stack 90 but allow a part of the surface to be exposed.

In a first embodiment, the packaging box 20 has an exit opening 25 for taking out the stack 90 such that a side surface 93 of the stack 90 comes first and a push opening 24 through which the stack 90 is pushed so that the stack 90 exits out, goes out, move out, is taken out, or is carried out through the exit opening 25.

The push opening 24 is a passage for the user to push out the glass slides 10 housed inside the packaging box 20 from the outside of the packaging box 20. The push opening 24 is formed to pass through a side surface portion 23 from the outside to the inside. The push opening 24 is formed to face at least one of the upper surface 91, lower surface 92, and four side surfaces 93. In the example in FIG. 1, the push opening 24 is formed at a portion of a side surface portion 23 so as to face a side surface 93. The push opening 24 may be an opening that is entirely open in a plane in which the side surface portion of the packaging box 20 does not extend.

The exit opening 25 is a passage for passing the stack 90 pushed through the push opening 24 to the outside of the packaging box 20. The exit opening 25 is an opening formed in the packaging box 20 and passes through the packaging box 20 from the outside to the inside. The exit opening 25 is formed to face one of the upper surface 91, lower surface 92, and four side surfaces 93. In the example of FIG. 1, the packaging box 20 has a push opening 24 formed on a side surface 93 side different from the side surface 93 side of the stack 90 on which an exit opening 25 is formed. This allows the user to push out the stack 90 easily and makes it possible to form packaging box 20 in a small size, compared with a configuration in which both the exit opening 25 and the push opening 24 are formed on the same side surface 93 side of the stack 90. In this case, the exit opening 25 and the push opening 24 may face any surfaces of the stack 90 as long as they are formed to face different surfaces of the stack 90.

In the example in FIG. 1, the packaging box 20 has the push opening 24 on the opposite side of the stack 90 from the exit opening 25. In other words, the stack 90 is housed in the packaging box 20 between the push opening 24 and the exit opening 25. With this configuration, when the stack 90 is pressed through the push opening 24 in direction P from the push opening 24 toward the exit opening 25 (hereinafter referred to as the push direction P), the stack 90 moves in the push direction P, passes through the exit opening 25, and is pushed out to the outside. In the example in FIG. 1, since the push opening 24 and the exit opening 25 face each other, the user can easily take out the stack 90 through the exit opening 25 just by pushing out a side surface 93 of the stack 90 toward the opposite exit opening 25 through the push opening 24.

The exit opening 25 has a width wide enough for the glass slide 10 to pass through. In other words, the width of the exit opening 25 is larger than or equal to the width of the glass slide 10 in the direction orthogonal to the push direction P. The lower surface of the exit opening 25 is formed to be on substantially the same plane as the inner surface of the lower surface portion 22 and continues to the inner surface of the lower surface portion 22. In other words, sliding the glass slides 10 from on the inner surface of the lower surface portion 22 in the push direction P allows the glass slides 10 to pass through the exit opening 25.

Figure 2A:
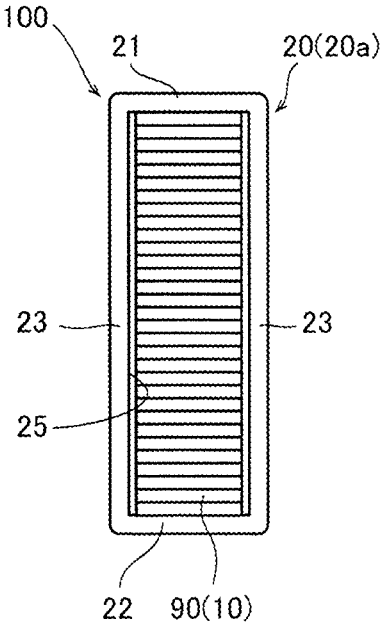
FIG. 2A is a side view illustrating a packaging box, such as in FIG. 1, on an exit opening side.
Figure 2B:
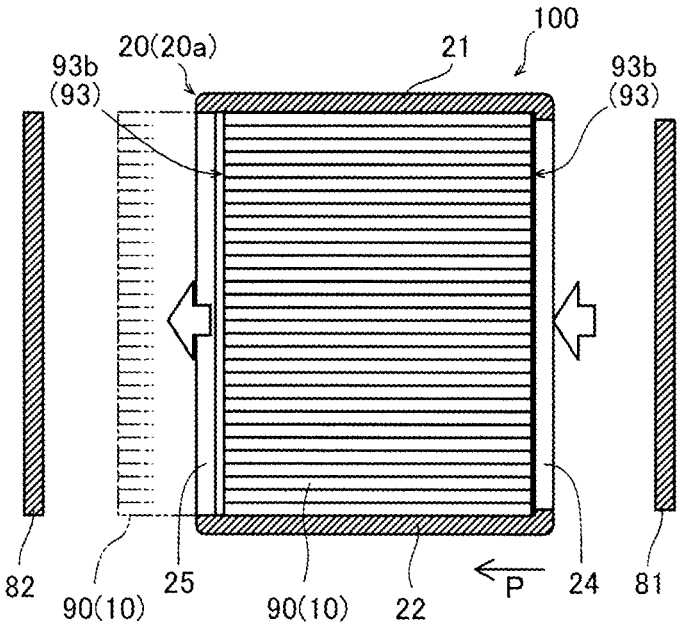
FIG. 2B is a longitudinal sectional view illustrating a packaging box, such as in FIG. 1.
Figure 3:
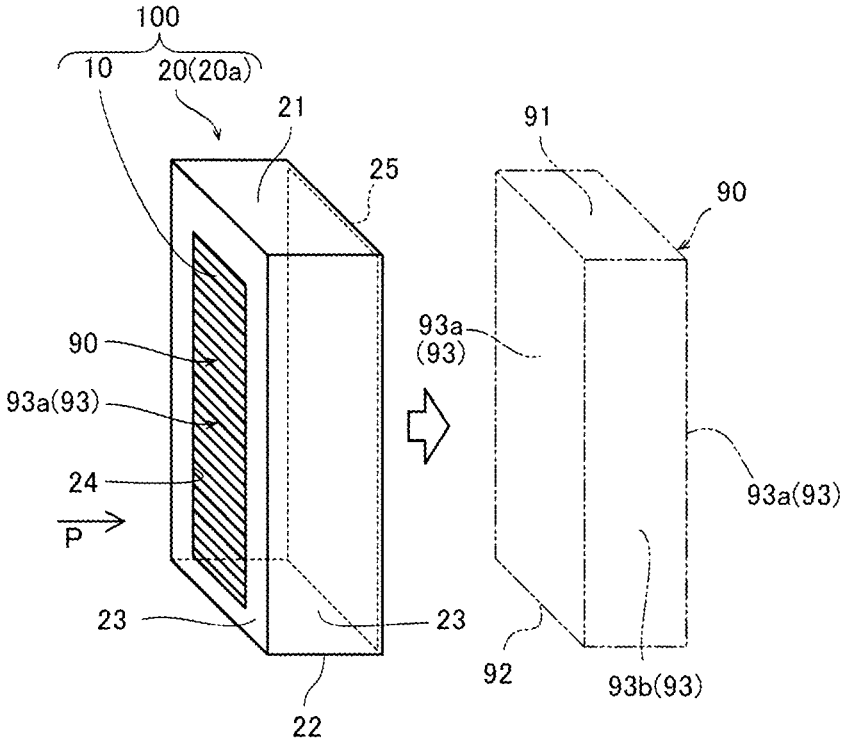
FIG. 3 is a perspective view illustrating another configuration example of a packaging box.
Figure 4A:
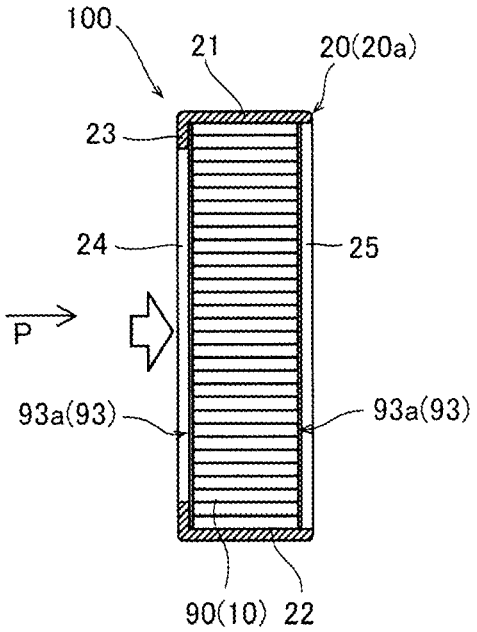
FIG. 4A is a longitudinal sectional view illustrating a packaging box, such as in FIG. 3, before glass slides are moved.
Figure 4B:
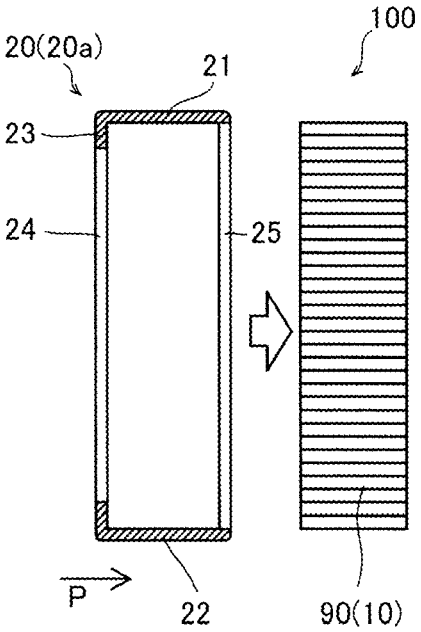
FIG. 4B is a longitudinal sectional view illustrating a packaging box, such as in FIG. 3, after glass slides are moved.

In the case where the exit opening 25 and the push opening 24 face each other in the packaging box 20, the exit opening 25 and the push opening 24 may be formed to face the short-side side surfaces 93*b* of the stack 90 or formed to face the long-side side surfaces 93*a* of the stack 90. In the case where the exit opening 25 and the push opening 24 face the short-side side surfaces 93*b* of the stack 90 as illustrated in FIGS. 1 and 2, the user pushes out the stack 90 in the direction along the long sides. In the case where the exit opening 25 and the push opening 24 face the long-side side surfaces 93*a* of the stack 90 as illustrated in FIGS. 3, 4A, and 4B, the user pushes out the stack 90 in the direction along the short sides.

The packaging box 20 may be formed using a single box body, or it may be formed using, for example, a combination of box bodies. In the example illustrated in FIG. 1, the packaging box 20 includes a box body 20*a* that covers at least a part of the upper surface 91, the lower surface 92, and the side surfaces 93 of the stack 90. In FIG. 1, the packaging box 20 includes a single box body 20*a*. In other words, the packaging box 20 includes the box body 20*a* having an upper surface portion 21 that faces the upper surface 91 of the stack 90, a lower surface portion 22 that faces the lower surface 92 of the stack 90, and side surface portions 23 that face the side surfaces 93 of the stack 90. The box body 20*a* has an exit opening 25 for taking out the stack 90 such that a side surface 93 of the stack 90 comes first and a push opening 24 through which the stack 90 is pushed so that the stack 90 exits out through the exit opening 25.

With the configuration above, in a first embodiment, the user can take out the stack 90 through the exit opening 25 just by pushing out one of the surfaces of the stack 90 of the glass slides 10 in the packaging box 20 through the push opening 24 toward the exit opening 25. Thus, when the user transfers the glass slides 10 from the packaging box 20 to the smear preparing apparatus, it is possible to transfer the glass slides 10 easily just by pushing out a portion of the glass slides 10, which is one of the surfaces of the stack 90, without touching the smear surface 11 of a glass slide 10. In addition, since there is no need to hold the glass slides 10 with the hands to take out the glass slides 10, but it is possible to send out the glass slides 10 from the inside of the packaging box 20, it is also possible to reduce the possibility of dropping the glass slides 10 or exerting an impact on the glass slides 10 when transferring them. In addition, since the packaging box 20 only needs to have the push opening 24 and the exit opening 25, a simple structure can be employed for the packaging box 20. As described above, it is possible to make the transfer work easy even in the case of transferring glass slides from a simple packaging box. Note that if the user touches the smear surface 11, foreign objects such as fingerprints or dust may adhere to the smear surface 11, leading to the degradation of the quality of smears. However, touching the opposite surface 12 or the end surfaces 13 other than the smear surface 11 does not affect the quality.

A method according to a first embodiment of setting glass slides 10 is described. A method of setting the glass slides 10 includes: (1) placing the exit opening 25 that is formed in the packaging box 20 to house the stack 90 of the glass slides 10 and through which the stack 90 exits, such that the exit opening 25 faces a glass slide setting part 200 (see FIG. 10) of the smear preparing apparatus;

(2) pushing out the stack 90 inside the packaging box 20 through the push opening 24 that faces a surface of the stack 90 different from a surface that the exit opening 25 faces; and (3) moving the pushed-out stack 90 from the packaging box 20 to the glass slide setting part 200 through the exit opening 25.

With this, the user can take out the stack 90 from the exit opening 25 just by pushing out one of the surfaces of the stack 90 of the glass slides 10 in the packaging box 20 through the push opening 24 toward the exit opening 25. Accordingly, when the user transfers the glass slides 10 from the packaging box 20 to the smear preparing apparatus, the user can transfer them easily without touching the smear surface 11 of a glass slide 10 just by pushing one of the surfaces. In addition, since there is no need to hold the glass slides 10 with the hands to take out the glass slides 10, but it is possible to send out the glass slides 10 from the inside of the packaging box 20, it is also possible to reduce the possibility of dropping the glass slides 10 or exerting an impact on the glass slides 10 when transferring them. Even in that case, since the packaging box 20 only needs to have the push opening 24 and the exit opening 25, a simple structure can be employed for the packaging box 20. As described above, it is possible to make the transfer work easy even in the case of transferring glass slides from a simple packaging box.

Note that the packaging box 20 may include, in addition to the box body 20*a*, a cover, a seal, a cushion, a cover member separate from the box body 20*a*, and other members. For example, each of the push opening 24 and the exit opening 25 may be a portion that is closed by a seal or a part of the box body 20*a* in the initial state, which is removed by the user. For example, in FIGS. 2A and 2B, a packaging box 20 includes a first cover member 81 for closing a push opening 24 and a second cover member 82 for closing an exit opening 25 in addition to a box body 20*a*. In FIGS. 2A and 2B, the packaging box 20 includes the box body 20*a* and cover members 20*b* integrally formed such that the box body 20*a* and the cover members 20*b* are separable. With this configuration, the glass slides 10 can be held firmly with the box body 20*a* and the cover members 20*b*, and the cover members 20*b* can be removed by the user when the glass slides 10 are moved out. When the user takes out the glass slides 10, the user removes both the first cover member 81 and second cover member 82.

The material of the packaging box 20 is not limited to specific ones but only needs to have a strength sufficient for transportation and storage of the glass slides 10. Thus, the material of the packaging box 20 may be metal, resin, paper, or other material, but it is preferable that the packaging box 20 be made of paper. This provides a simple packaging box 20 the costs of which is low and which is less likely to affect the environmental load, compared with the case of using, for example, a resin container. Even in that case, it is easy to transfer the glass slides. The material of the packaging box 20 may be common cardboard used for paper packaging boxes or may be corrugated cardboard, resin impregnated paper, laminated material of paper material and material other than paper, or the like.

Configuration Example of Glass Slide Set

Hereinafter, with reference to FIG. 5 and subsequent figures, description is provided for specific configuration examples of the glass slide set 100.

Figure 5:
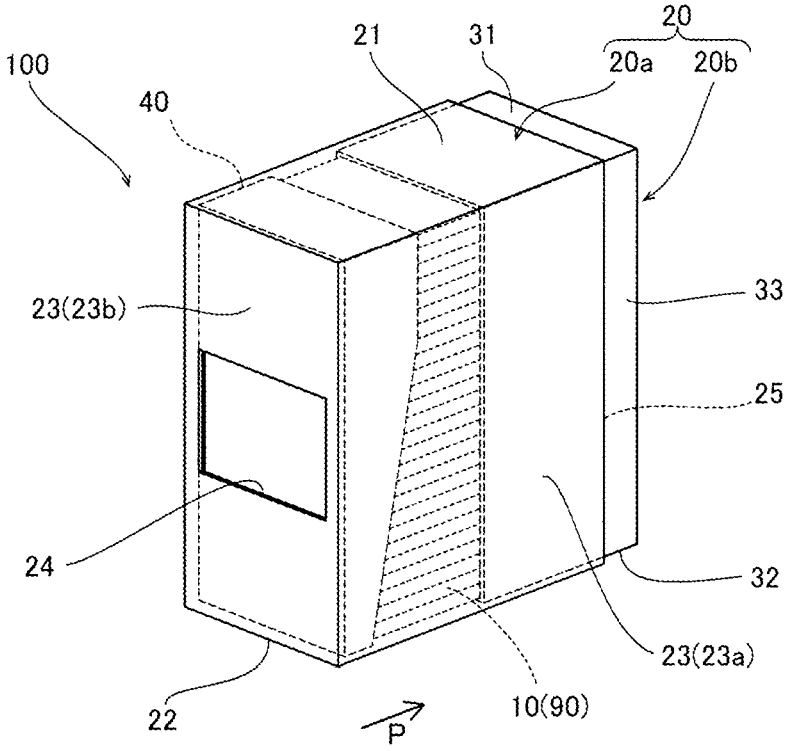
FIG. 5 is a perspective view illustrating a configuration example of a glass slide set.

A glass slide set 100 illustrated in FIG. 5 includes glass slides 10 and a packaging box 20 including members.

Figure 6:
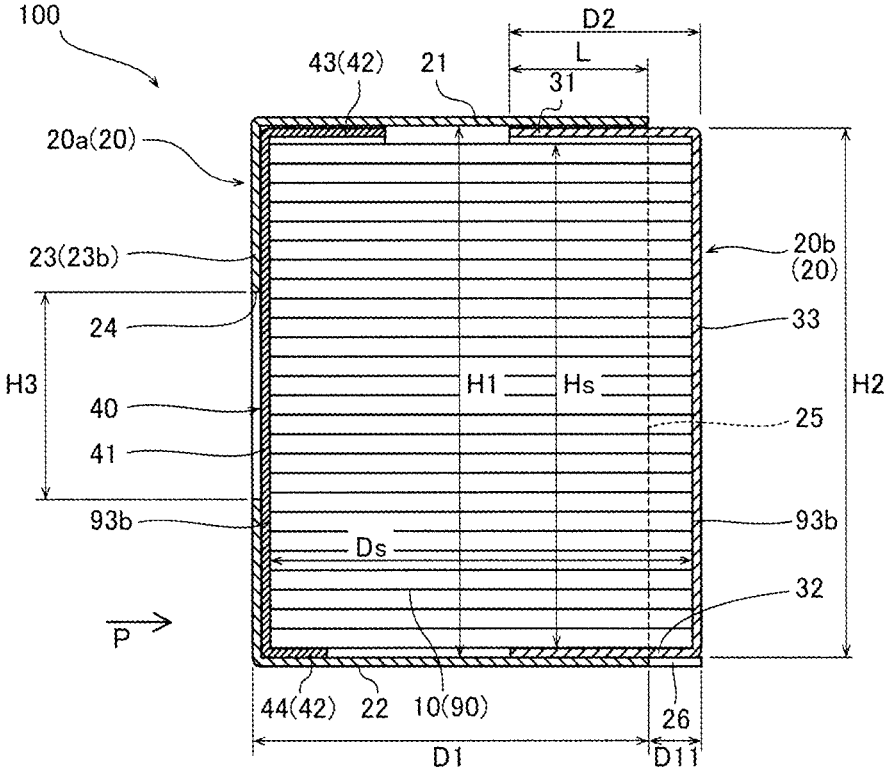
FIG. 6 is a longitudinal sectional view illustrating a glass slide set, such as in FIG. 5.

The packaging box 20 includes a box body 20*a*, a push member 40, and a cover member 20*b*. In the example in FIG. 5, the packaging box 20 is made of paper. In other words, all of the box body 20*a*, the push member 40, and the cover member 20*b* are made of paper. The packaging box 20 in FIG. 5 is formed by connecting the box body 20*a* and the cover member 20*b* to each other at the opening portion and wrapping the periphery of the connected box body 20*a* and cover member 20*b* with packaging material such as resin film (not illustrated). A label or the like for fixation may be attached to extend over the box body 20*a* and the cover member 20*b*. As illustrated in FIG. 6, a stack 90 of the glass slides 10 is housed inside the box body 20*a* and the cover member 20*b* so as to be sandwiched by the box body 20*a* and the cover member 20*b* from the short sides.

Figure 7:
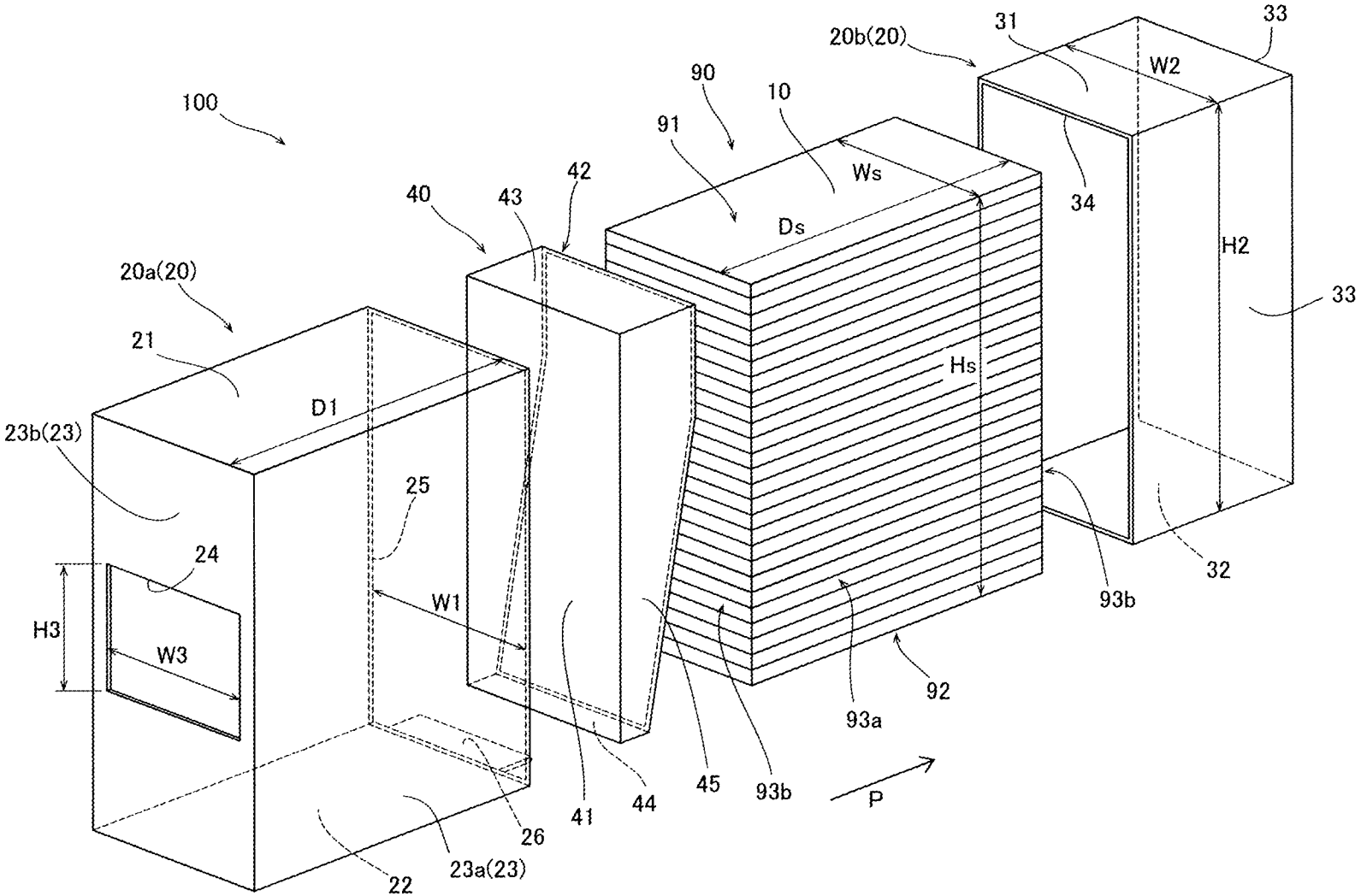
FIG. 7 is an exploded perspective view illustrating a glass slide set, such as in FIG. 5.

As illustrated in FIG. 7, the box body 20*a* has an upper surface portion 21 and a lower surface portion 22, and side surface portions 23. The box body 20*a* has a rectangular parallelepiped shape constituted of the upper surface portion 21, lower surface portion 22, and side surface portions 23. The box body 20*a* also includes a push opening 24 and an exit opening 25. The upper surface portion 21 is formed in a flat plate shape along the upper surface 91 of the stack 90. The lower surface portion 22 is formed in a flat plate shape along the lower surface 92 of the stack 90. The side surface portions 23 are formed in flat plate shapes along the side surfaces 93 of the stack 90.

The side surface portions 23 of the box body 20*a* are formed to face three surfaces, a pair of long-side side surfaces 93*a* and one of a pair of short-side side surfaces 93*b* of the stack 90. The exit opening 25 is adjacent to the side surface portions 23 of the box body 20*a*, faces the other one of the pair of short-side side surfaces 93*b* and is entirely open in a plane in which the side surface portion 23 does not extend. In other words, the side surface portions 23 include a pair of first side surface portions 23*a* (see FIG. 8) which respectively faces a pair of long-side side surfaces 93*a* of the stack 90 and one second side surface portion 23*b* which faces one short-side side surface 93*b* of the stack 90. The push opening 24 is formed to face a short-side side surface 93*b* of the stack 90. In other words, the push opening 24 is formed in the second side surface portion 23*b*. The exit opening 25 is formed on the opposite side of the box body 20*a* from the push opening 24. In other words, the exit opening 25 faces the second side surface portion 23*b* in which the push opening 24 is provided. The exit opening 25 is an opening that is entirely open in a plane in which the side surface portion 23 does not extend. More specifically, the exit opening 25 is adjacent to the pair of first side surface portions 23*a*. The user can push out the stack 90 through the push opening 24 in the push direction P and take out the stack 90 from the exit opening 25.

As described above, the exit opening 25 can be formed by designing one side surface of the box body 20*a* in a rectangular parallelepiped shape to be an opening. Thus, it is possible to form the simple box body 20*a* that is capable of housing the stack 90 of the glass slides 10 as small as possible, and it is also possible to take out the stack 90 easily from the exit opening 25, which is open at one side surface of the box body 20*a*.

In the example in FIGS. 5 to 7, the push opening 24 faces one short-side side surface 93*b* of the stack 90. The exit opening 25 allows the short-side side surfaces 93*b* of the stack 90 to pass through. Thus, the user can push out the stack 90 in the direction along the long sides thereof to take out the stack 90 from the box body 20*a*. In this case, the moving distance by which the glass slides 10 need to be pushed out is longer than in the case of being pushed out in the direction along the short sides. However, this makes it possible to reduce the possibility of the user mistakenly dropping the glass slides 10 from the exit opening 25, according to the long moving distance.

The push member 40 is disposed on the opposite side of the stack 90 from the exit opening 25 and provided to be capable of moving the housed stack 90 toward the exit opening 25. In FIG. 5, the push member 40 is disposed between the stack 90 and the push opening 24 inside the box body 20*a*. In other words, the push member 40 is between the user's fingers and the stack 90 when the user is pushing out the stack 90 through the push opening 24, and the push member 40 moves together with the stack 90 in the push direction P.

Here, in the case where the user presses the stack 90 with the user's fingers through the push opening 24, the user's fingers touch the end surfaces 13 of the glass slides 10. Thus, providing the push member 40 allows the user to push the push member 40 through the push opening 24 to push out the stack 90 through the push member 40 toward the exit opening 25. Hence, the user can transfer the glass slides 10 easily without touching them.

The cover member 20*b* is provided separately from the box body 20*a* so as to house the stack 90 from the exit opening 25 side of the box body 20*a*. In other words, the packaging box 20 includes the cover member 20*b* which is separate from the box body 20*a* and covers the face on the exit opening 25 side of the stack 90. This prevents the glass slides 10 from coming out through the exit opening 25 using the cover member 20*b* at the time other than when the glass slides 10 are transferred. The user can take out the glass slides 10 from the exit opening 25 easily by removing the cover member 20*b* before transferring the glass slides 10.

In the example in FIG. 7, the cover member 20*b* has a rectangular parallelepiped including an upper surface portion 31, lower surface portion 32, and, and side surface portions 33. The upper surface portion 31, lower surface portion 32, and side surface portions 33 each have a flat plate shape. The side surface portions 33 of the cover member 20*b* are formed to face three surfaces, a pair of long-side side surfaces 93*a* and one short-side side surface 93*b* of the stack 90. In addition, the cover member 20*b* has an opening 34, which is entirely open at one side of the cover member 20*b*. The cover member 20*b* is formed such that an internal space in a rectangular parallelepiped shape constituted of the upper surface portion 31, lower surface portion 32, and side surface portions 33 houses a part of the stack 90 inserted from the opening 34.

In the example in FIGS. 5 to 7, the packaging box 20 is formed such that the box body 20*a* and the cover member 20*b* cover the upper surface 91, lower surface 92, and side surfaces 93 of the stack 90. With this configuration, the box body 20*a* and the cover member 20*b* firmly hold the glass slides 10.

In the example in FIGS. 5 to 7, the box body 20*a* and the cover member 20*b* are disposed such that the exit opening 25 of the box body 20*a* and the opening 34 of the cover member 20*b* faces in the directions opposite to each other. The box body 20*a* houses the stack 90 from one short-side side, and the cover member 20*b* houses the stack 90 from the other short-side side. The second side surface portion 23*b* of the box body 20*a* faces one short-side side surface 93*b* of the stack 90, and a side surface portion 33 of the cover member 20*b* faces the other short-side side surface 93*b* of the stack 90. In addition, as illustrated in FIG. 6, the end portion on the exit opening 25 side of the box body 20*a* and the end portion on the opening 34 side of the cover member 20*b* overlap with each other.

Box Body

In the example in FIG. 6, the height H1 from the lower surface portion 22 to the upper surface portion 21 of the box body 20*a* is larger than the height Hs of the stack 90 and substantially equal to the height H2 of the push member 40 and the cover member 20*b*. In the example in FIG. 7, the width W1 between the pair of first side surface portions 23*a* of the box body 20*a* is larger than the width Ws of the short sides of the stack 90 and is substantially equal to the width W2 of the push member 40 and the cover member 20*b*.

In the stacking direction of the stack 90, the width W3 of the push opening 24 is smaller than the width Ws of the side surface 93 on the push opening 24 side. This prohibits each of the glass slides 10 from passing through the push opening 24 and thus positively prevents the glass slides 10 from protruding from the push opening 24.

In the example in FIG. 6, the push opening 24 has a height dimension of H3, which is smaller than the height Hs of the stack 90. The height dimension H3 of the push opening 24 is, for example, larger than or equal to one-third and smaller than two-thirds of the box body 20*a*. Since each of the glass slides 10 in the stack 90 can be uniformly pressed by using the push member 40, the push opening does not have to have a length from the upper end to the lower end of the stack 90. In the example in FIGS. 5 to 7, the push opening 24 has a rectangular shape with a height dimension of H3 and a width of W3, and one push opening 24 is formed at around the center of the second side surface portion 23*b*.

Here, in the example in FIG. 6, the stack 90 is placed such that the distal end portion of the stack 90 that is directed from the side opposite to the exit opening 25 toward the exit opening 25 is exposed from the exit opening 25. With this configuration, when transferring the glass slides 10, the user can move out the stack 90 to transfer the glass slides 10 in the state where the distal end portions of the glass slides 10 exposed from the exit opening 25 are partially inserted into the inside of the glass slide setting part 200. This, in turn, makes it possible to transfer the glass slides 10 easily without the distal end portions of the glass slides 10 being caught. Note that the portion of the stack 90 exposed from the box body 20*a* is covered with the cover member 20*b* as described above.

Specifically, the length D1 of the side surface portions 23 of the box body 20*a* in the push direction P from the push opening 24 toward the exit opening 25 is smaller than the length Ds of the stack 90. Accordingly, the end portion of the stack 90 on the exit opening 25 side protrudes from the exit opening 25 of the box body 20*a* in the push direction P. This setting makes the stack 90 in the box body 20*a* be partially exposed from the exit opening 25. With this configuration, when transferring the glass slides 10, the user can move out the stack 90 to transfer the glass slides 10 in the state where the distal end portions of the glass slides 10 exposed from the exit opening 25 are partially inserted into the inside of the glass slide setting part 200 (see FIG. 10). This, in turn, makes it possible to transfer the glass slides 10 easily without the distal end portions of the glass slides 10 being caught.

Figure 10:
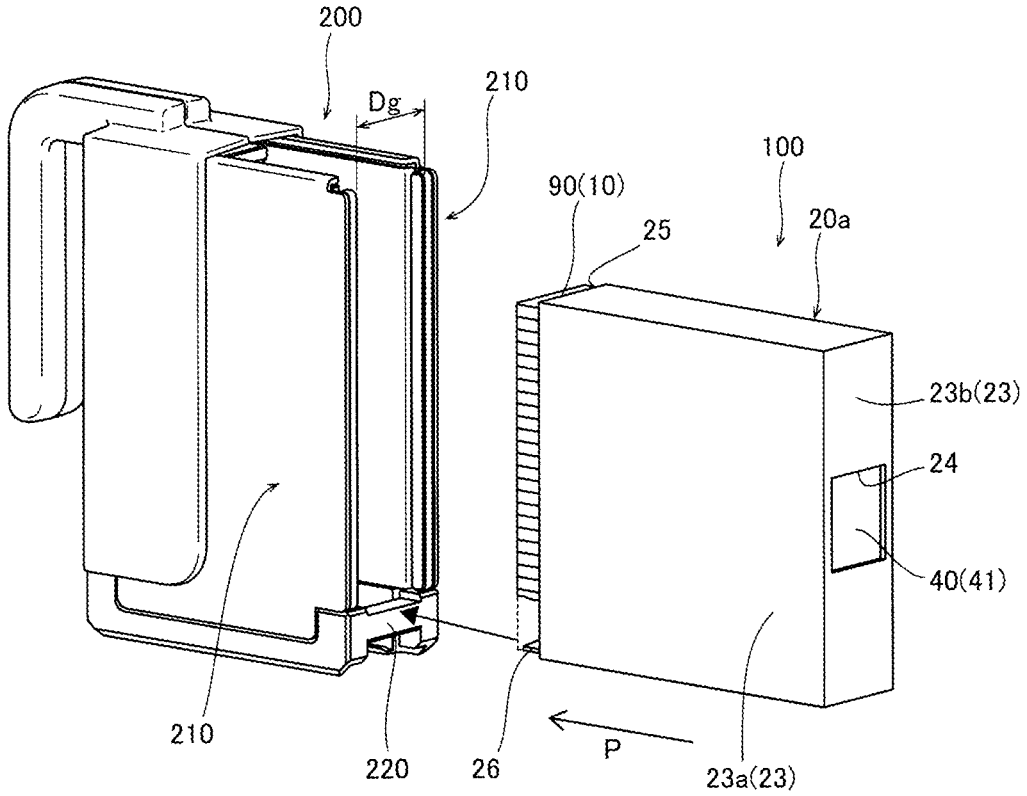
FIG. 10 is a perspective diagram illustrating work to transfer glass slides from a packaging box to a glass slide setting part.

The box body 20*a* includes an engagement portion 26, which protrudes from the end portion on the exit opening 25 side of the box body 20*a* in the direction from the push opening 24 toward the exit opening 25 and is engaged with the glass slide setting part 200 of the smear preparing apparatus. The engagement portion 26 protrudes relative to the ends of the side surface portions 23 of the box body 20*a* in the push direction P. The engagement portion 26 is the most protruding portion of the box body 20*a* in the push direction P. As illustrated in FIG. 10, the engagement portion 26 has a function of being inserted into the glass slide setting part 200 of the smear preparing apparatus and adjusting the relative position between the exit opening 25 of the box body 20*a* and the receiving portion of the glass slide setting part 200 when the stack 90 is pushed out. With this configuration, when the user transfers the glass slides 10, the user can adjust the position of the packaging box 20 easily by engaging the engagement portion 26 with the glass slide setting part 200. This makes the transfer work much easier.

The engagement portion 26 is formed at the lower surface portion 22 of the box body 20*a* or between the lower surface portion 22 and the stack 90 and has a plate shape extending along the lower surface 92 of the stack 90 in the push direction. In the example in FIG. 8, in the box body 20*a*, the engagement portion 26 is formed integrally with the lower surface portion 22 so as to extend from the lower surface portion 22 in the push direction P. The width W11 of the engagement portion 26 is smaller than the width W12 of the lower surface portion 22 and smaller than the width Ws of the stack 90 (see FIG. 7). As illustrated in FIG. 6, the engagement portion 26 extends to almost the same position as the end portion of the stack 90 protruding from the exit opening 25. In other words, the sum (D11+D1) of the protrusion amount D11 of the engagement portion 26 and the length D1 of the side surface portions 23 is almost the same as the length Ds of the stack 90.

Figure 11:
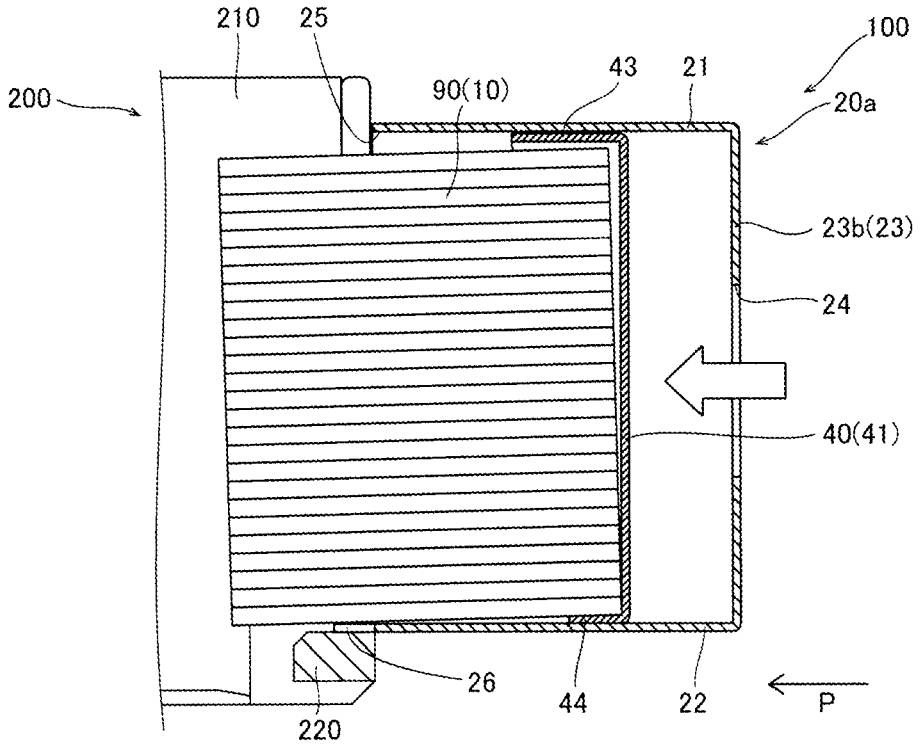
FIG. 11 is a schematic longitudinal sectional diagram illustrating work to transfer glass slides.

Forming the engagement portion 26 at the lower surface portion 22 allows the user to push out the stack 90 to the glass slide setting part 200 in the state where the engagement portion 26 is engaged so as to go over the setting surface of the glass slide setting part 200 (see FIG. 11). This reduces the possibility of the glass slides 10 being caught with a gap which might be made between the glass slide setting part 200 and the box body 20*a*, and thus makes it possible to transfer the glass slides 10 smoothly. The engagement portion 26 also functions as a protector that protects the lower surface 92 of the stack 90.

Figure 8:
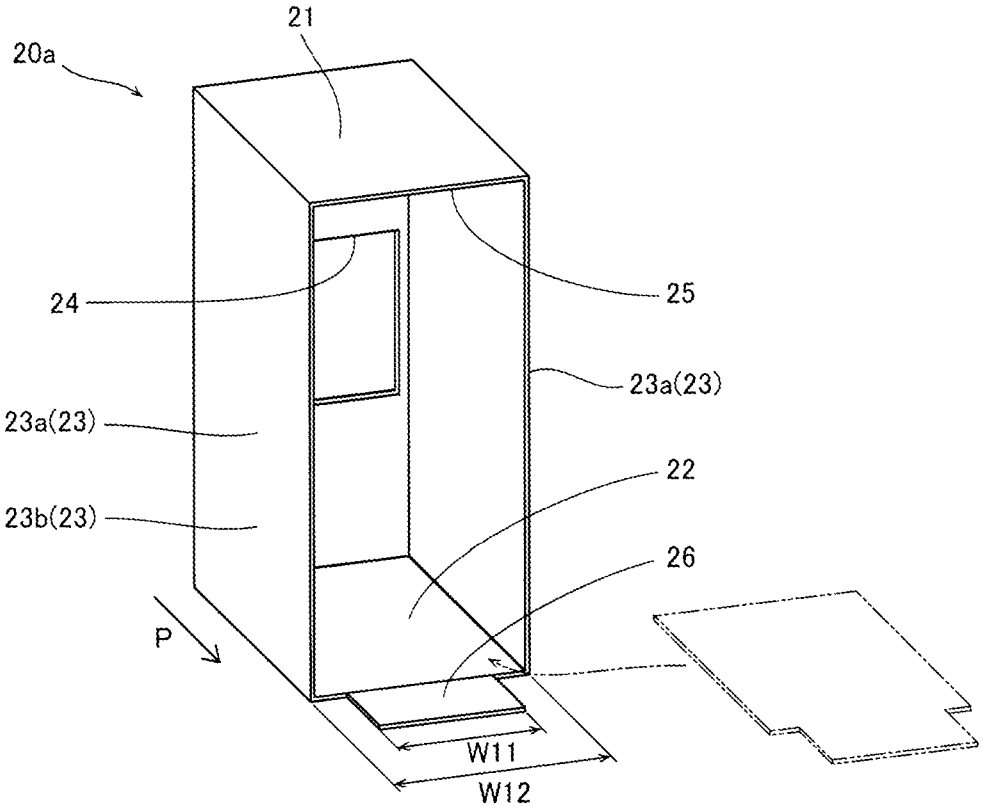
FIG. 8 is a perspective view illustrating a configuration example of a box body.

Note that the engagement portion 26 may be formed as a part of the lower surface portion 22 of the box body 20*a* as illustrated in FIG. 8, or the engagement portion 26 may be a separate plate member (see the chain double-dashed lines) disposed between the lower surface portion 22 and the stack 90. In the case where the engagement portion 26 is a separate plate member, the engagement portion 26 may be attached to the lower surface portion 22.

In the example in FIG. 8, the exit opening 25 is formed almost as large as the side surface 93 of the stack 90 on the exit opening 25 side. With this configuration, the exit opening 25 can have a minimum size that allows the stack 90 to pass therethrough, which reduces displacement of each glass slide 10 when the glass slides 10 are moved.

Cover Member

In the example in FIGS. 5 to 7, the cover member 20*b* is placed such that the end portion on the opening 34 side of the cover member 20*b* passes through the exit opening 25 and fits into the inside of the box body 20*a*. In other words, the cover member 20*b* is formed to house the stack 90, and the box body 20*a* is formed to be slightly larger than the cover member 20*b* (the cover member 20*b* is formed to be slightly smaller than the box body 20*a*) so that the box body 20*a* can house a part of the stack 90 and a part of the cover member 20*b*. When taking out the glass slides 10 from the packaging box 20, the user removes the cover member 20*b* and then presses the push member 40 through the push opening 24 of the box body 20*a* to push out the stack 90 from the exit opening 25.

In the example in FIGS. 5 to 7, the length D2 of the cover member 20*b* is smaller than the length of the box body 20*a*. The height H2 (see FIG. 6) and the width W2 (see FIG. 7) of the cover member 20*b* are smaller than the height H1 and the width W1 of the box body 20*a*. With this setting, the cover member 20*b* fits into the box body 20*a* from the exit opening 25 side.

The length D2 of the cover member 20*b* only needs to be long enough to cover the entire stack 90 together with the box body 20*a*. In other words, if the thickness of the box body and other factors are excluded for the sake of simplification, the length D2 of the cover member 20*b* only needs to satisfy (D1+D2) Ds. In the example in FIG. 6, the sum of lengths (D1+D2) is longer than the length Ds of the stack 90 by the length L, which is the length of the overlapping portion of the box body 20*a* and the cover member 20*b*. Note that it is preferable that the length D1 (the length excluding the engagement portion 26) of the box body 20*a* in the push direction P be larger than or equal to a half the length Ds of the glass slides 10 so that the glass slides 10 can be stably held after the cover member 20*b* is removed.

Push Member

In the example in FIGS. 5 to 7, the push member 40 is formed to extend in the up-down direction along the short-side side surface 93*b* of the stack 90, which is on the opposite side from the exit opening 25. The push member 40 is provided separately from the box body 20*a* and has an outside shape larger than the push opening 24 in the plane on which the push opening 24 is formed. Thus, in the box body 20*a*, a part of the push member 40 is exposed via the push opening 24 across the entire push opening 24. With this configuration, the area of the push member 40 can be large, and this allows the user to apply force to a wide area of the side surface 93 of the stack 90. This reduces displacement of each of the glass slides 10 in the stack 90 when the glass slides 10 are moved from the box body 20*a*, and thus the glass slides 10 inside the box body 20*a* can be moved together. In addition, even in the case of a large push opening 24, the push member 40 covers the push opening 24, preventing the glass slides 10 from protruding from the push opening 24. Thus, the push member 40 also functions as an internal cover that covers the push opening 24 from the inside.

The outside shape of the push member 40 has almost the same as the cover member 20*b* in width and height (see FIG. 7). In other words, as illustrated in FIG. 9, the push member 40 has a width of W2 and a height of H2.

Figure 9:
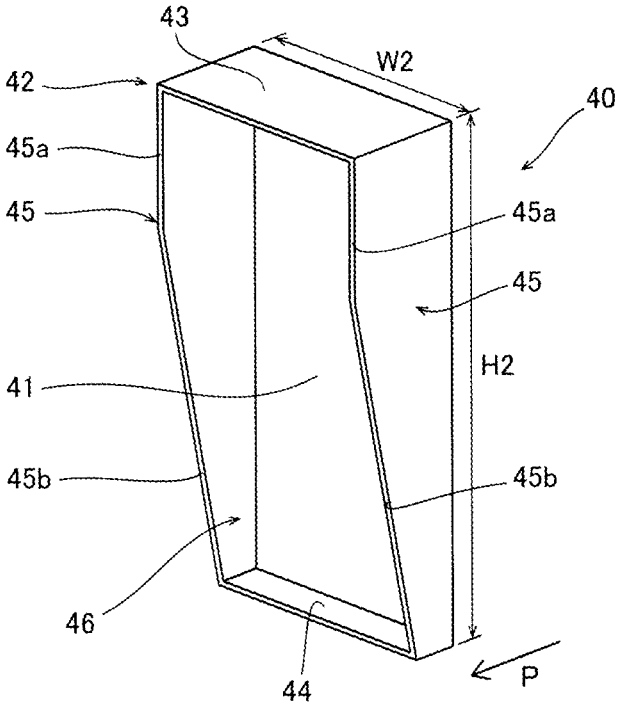
FIG. 9 a perspective view illustrating a configuration example of a push member.

In the example in FIGS. 9 and 6, the push member 40 includes a first part 41 disposed on the opposite side of the stack 90 from the exit opening 25 and a second part 42 which is connected to the first part 41 and covers at least a part of the upper surface 91, the lower surface 92, or the side surfaces 93*a* adjacent to the side surface 93*b* of the stack 90 on the first part 41 side.

The first part 41 is a portion extending in the up-down direction along the side surface 93 of the stack 90. The first part 41 is exposed to the outside of the box body 20*a* via the push opening 24. The second part 42 is substantially orthogonal to the first part 41 and extends along surfaces of the stack 90. In other words, the second part 42 extends inside the box body 20*a* along at least one of the upper surface portion 21, lower surface portion 22, or the first side surface portions 23*a*. With this configuration, the second part 42 improves the rigidity of the push member 40, compared with a push member 40 having only the first part 41 where the user touches, which reduces the deflection of the push member 40 which may occur when the stack 90 is pushed out and makes it easy to push out the stack 90. In addition, since the second part 42 is disposed between the box body 20*a* and the stack 90, the second part 42 functions as a guide when the push member 40 is moved inside the box body 20*a*, making it possible to move the push member 40 smoothly.

In the example in FIG. 9, the first part 41 is a plate portion formed to face a short-side side surface 93*b* of the stack 90 and have almost the same shape as the short-side side surface 93*b*. Thus, the first part 41 touches substantially the entire surface of the short-side side surface 93*b* of the stack 90.

In the example in FIG. 9, the second part 42 has an upper part 43 extending along the upper surface 91 of the stack 90 and a lower part 44 extending along the lower surface 92 of the stack 90. In other words, the upper part 43 is disposed between the upper surface 91 of the stack 90 and the upper surface portion 21 of the box body 20*a*. The lower part 44 is disposed between the lower surface 92 of the stack 90 and the lower surface portion 22 of the box body 20*a*. The push member 40 is formed to hold the stack 90 between the upper part 43 and the lower part 44. This allows the stack 90 to be moved toward the exit opening 25 in the state where the push member 40 holds the stack 90 so as to pinch it with the upper part 43 and the lower part 44 in the up-down direction, making it possible to take out the glass slides 10 in the box body 20*a* together more positively.

The upper part 43 and the lower part 44 are plate parts respectively extending along the upper surface 91 and lower surface 92 of the stack 90. Each of the upper part 43 and the lower part 44 is formed to extend from one end portion to the other end portion of the first part 41 in the width direction.

In the example in FIG. 9, the second part 42 has a pair of side parts 45 extending along the pair of side surfaces 93*a* adjacent to the side surface 93*b* of the stack 90 on the first part 41 side. The side part 45 is disposed between the long-side side surface 93*a* of the stack 90 and the first side surface portion 23*a* of the box body 20*a*. The push member 40 holds the stack 90 between the pair of side parts 45. This allows the stack 90 to be moved toward the exit opening 25 in the state where the push member 40 holds the stack 90 so as to pinch it with the pair of side parts 45 in the right-left direction, making it possible to take out the glass slides 10 in the box body 20*a* together more positively. In particular, in the case where the number of stacked glass slides 10 is large, the height of the side surfaces 93 of the stack 90 is large, and the height of the first part 41 is likely to be large. However, the side parts 45 extending along the side surfaces 93*a* function as reinforcement of the first part 41 and reduce the deflection of the push member 40 when the push member 40 is pressed.

In the example in FIG. 9, each of the paired side parts 45 is a plate part extending the corresponding one of the different long-side side surfaces 93*a* of the stack 90. Each of the side parts 45 is formed to extend from the upper end portion to the lower end portion of the first part 41.

In the example in FIG. 9, the second part 42 is annularly continuous so as to surround the stack 90 along the upper surface 91, the lower surface 92, and the pair of side surfaces 93*a*, adjacent to the side surface 93*b* on the first part 41 side, of the stack 90. In other words, the upper part 43, pair of side parts 45, and lower part 44 of the second part 42 are not only connected to the first part 41 but also connected to one another at the adjacent end portions. The upper part 43 and the lower part 44 are formed to connect the pair of side parts 45 at one end portions and the other end portion thereof in the width direction. The side parts 45 are formed to connect the upper part 43 and the lower part 44 at the upper end portions and lower end portions thereof.

With this configuration, the push member 40 has a recessed part 46 constituted of the first part 41 and the annular second part 42. Then, the stack 90 is placed to fit in the recessed part 46 constituted of the first part 41 and the annular second part 42. In other words, the first part 41 and the annular second part 42 forms the recessed part 46 that accommodates the stack 90. With this configuration, the end portion of the stack 90 opposite from the exit opening 25 is placed inside the recessed part 46 of the push member 40 and held stably. This effectively reduces displacement of each of the glass slides 10 when the stack 90 exits from the box body 20*a*, and thus the glass slides 10 inside the box body 20*a* can be moved together more positively.

As described above, the push member 40 is formed in the box body 20*a* so as to cover substantially the entire side surface 93*b* of the stack 90 on the first part 41 side. As a result, the push member 40 makes it possible to push substantially the whole of the side surface 93*b* of the stack 90 on the first part 41 side to move the stack 90, and thus this also makes it possible to take out the glass slides 10 in the box body 20*a* together more easily and positively.

Here, in the example in FIG. 9, the ends of the side parts 45 on the exit opening 25 side are inclined to get closer to the first part 41 as extending toward the lower surface 92 of the stack 90. Specifically, the end of each side part 45 on the exit opening 25 side has a linear portion 45*a* extending downward almost in parallel with the first part 41 in a certain length range from the upper end and a slant portion 45*b* inclined linearly so as to get closer to the first part 41 as extending toward the lower part 44 in the range below the linear portion 45*a*. In other words, the linear portions 45*a* on the upper end side protrude in the push direction P toward the exit opening 25 relative to the slant portions 45*b* on the lower end side.

Here, consider the case of moving the stack 90 from the inside of the box body 20*a* to the glass slide setting part 200 as illustrated in FIGS. 10 and 11.

The glass slide setting part 200 illustrated in FIG. 10 has a pair of side guides 210 on the both sides of the stack 90 of the glass slides 10 in the direction along the short sides. The distance Dg between the pair of side guides 210 is substantially equal to the width Ws of the glass slides 10. The glass slide setting part 200 receives the glass slides 10 which are inserted between the pair of side guides 210 in the direction along the long sides of the glass slides 10. Thus, as illustrated FIG. 11, moving forward the push member 40 in the push direction P allows the distal end portion of the stack 90 to be inserted together between the pair of side guide 210.

Figure 12:
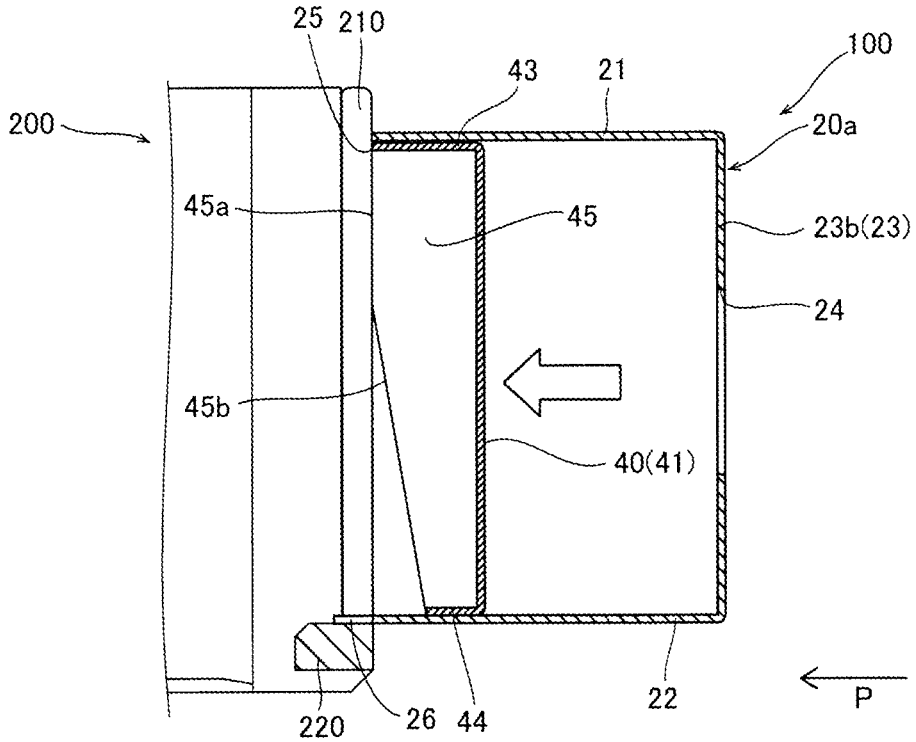
FIG. 12 is a longitudinal sectional diagram illustrating a state where a push member is pushed in inside a box body.

When moving forward the push member 40 in the push direction P, the push member 40 can push out the stack 90 into the glass slide setting part 200 until the linear portions 45*a* of the side parts 45 come into contact with the pair of side guide 210 of the glass slide setting part 200 as illustrated in FIG. 12. In this case, since the slant portions 45*b* of the side parts 45 are inclined toward the first part 41, even after the linear portions 45*a* of the side parts 45 come into contact with the glass slide setting part 200, the slant portions 45*b* on the lower sides of the side parts 45 remain in no contact with the glass slide setting part 200. Note that in FIGS. 12 and 13, an illustration of the stack 90 is omitted for the sake of convenience.

Figure 13:
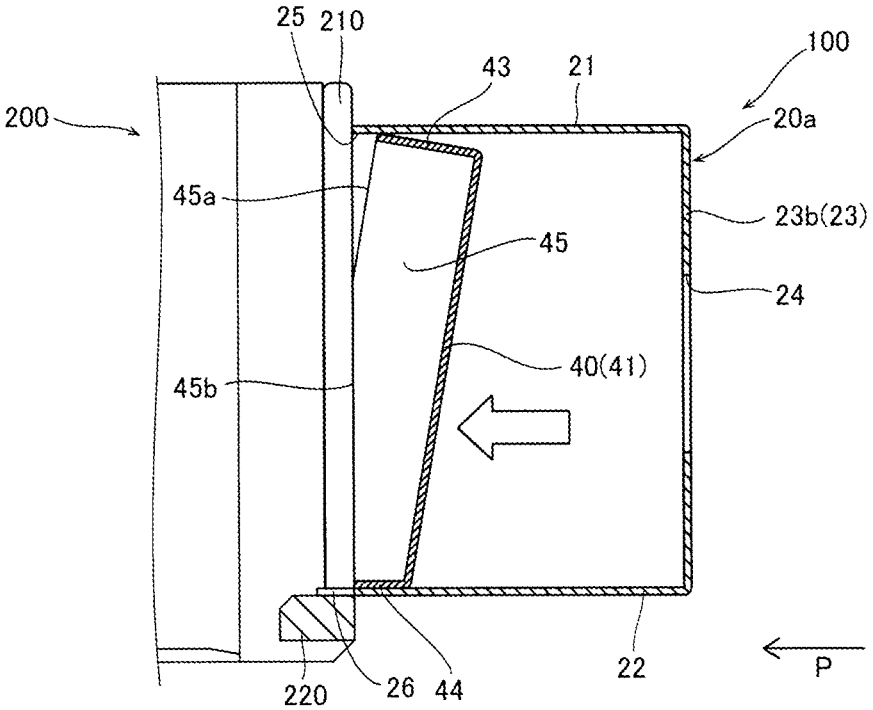
FIG. 13 is a longitudinal sectional diagram illustrating a state where a lower portion of a push member is further pushed in from a state, such as in FIG. 12.

Thus, as illustrated in FIG. 13, the user can further push the lower part of the push member 40 by pushing a lower portion of the first part 41, close to the lower surface 92 of the stack 90, until the slant portions 45*b* of the side parts 45 come into contact with the glass slide setting part 200, and thus the user can push out the stack 90 into the glass slide setting part 200. By doing so, the user can move most part of the stack 90 easily into the glass slide setting part 200 just by pushing the push member 40. When lower glass slides 10 are pushed out, stacked upper glass slides 10 move together, which increases the total push-out distance of the stack 90.

Work to Transfer Glass Slides

Next, description is provided for the work to transfer glass slides 10 in the packaging box 20 according to the example in FIGS. 5 to 9. First, the user removes the cover member 20*b* from the packaging box 20. By doing this, the distal end portion of the stack 90 on the exit opening 25 side is exposed to the outside of the box body 20*a* as illustrated in FIG. 10.

Next, as illustrated in FIG. 10, the user adjusts the position of the box body 20*a* on the exit opening 25 side with respect to the receiving portion of the glass slide setting part 200 of the apparatus to which the glass slides 10 are to be set. On the exit opening 25 side of the box body 20*a* are exposed the engagement portion 26 and the distal end of the stack 90. Accordingly, the user inserts the engagement portion 26 and the distal end of the stack 90 into between the pair of side guides 210 of the glass slide setting part 200 and places the engagement portion 26 on the upper surface of a support portion 220 of the glass slide setting part 200 to engage the engagement portion 26 with the glass slide setting part 200.

As a result of this work, the distal ends of all the glass slides 10 are placed between the pair of side guides 210, and the lowermost glass slide 10 is placed on the support portion 220 via the engagement portion 26. The ends of the upper surface portion 21 and the side surface portions 23 of the box body 20*a* come into contact with the pair of side guides 210, so that the orientation of the box body 20*a* is adjusted to be aligned with the direction of inserting the glass slides 10. Thus, just moving the stack 90 in the push direction P sends all the glass slides 10 into the glass slide setting part 200 without the glass slides 10 being caught at the side guides 210 or the support portion 220.

As illustrated in FIG. 11, the user presses the push member 40 through the push opening 24 toward the exit opening 25 in the push direction P, keeping the position of the box body 20*a*. Since the push member 40 holds the end portion of the stack 90 on the first part 41 side in the recessed part 46 using the first part 41 and the second part 42, all the glass slides 10, remaining stacked, move together with the push member 40 in the push direction P.

When the user pushes in the push member 40 as illustrated in FIG. 12, the linear portions 45*a*, which are the distal ends of the push member 40, come into contact with the side guide 210, and the push member 40 stops. In this state, when the user further pushes in a lower side of the push member 40, the lower portion of the push member 40 is further pushed in in the push direction P until the slant portions 45*b* of the side parts 45 of the push member 40 come into contact with the side guides 210 (see FIG. 13). When the lower portion of the stack 90 is pushed in, the upper portion of stacked glass slides 10 are further sent together into the glass slide setting part 200.

After pushing in the push member 40, the user removes the box body 20*a* from the glass slide setting part 200. By pushing in the push member 40 until the slant portions 45*b* come into contact with the side guides 210, it is possible to reduce the possibility that the sent-in glass slides 10 move back and come out of the glass slide setting part 200 after removing the box body 20*a* from the glass slide setting part 200.

In this way, the glass slides 10 are transferred from the packaging box 20 into the glass slide setting part 200. In the transfer work described above, the user can transfer the glass slides 10 without touching them. Note that if the glass slides 10 have not been sent deep enough into the glass slide setting part 200, the user may further push in the short-side side of the glass slides 10 to complete setting of the glass slides 10. Even in this case, since most part of the glass slides 10 have been sent into the glass slide setting part 200, it is possible to avoid the user touching the smear surface 11 of a glass slide 10.

Modifications

Figure 14A:
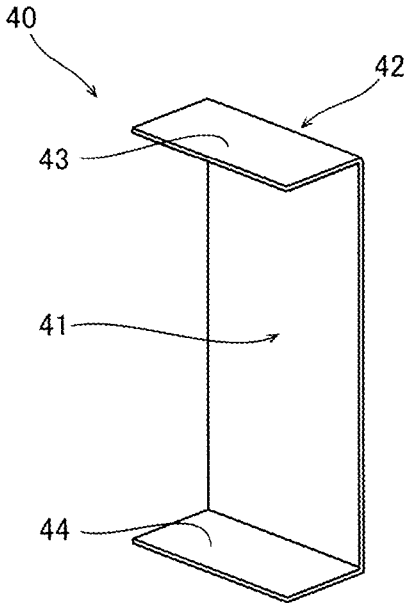
FIGS. 14A to 14D are perspective views each illustrating a configuration example of a push member.
Figure 14B:
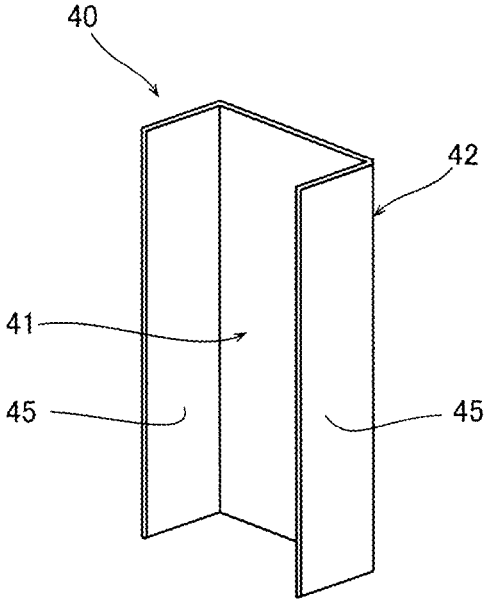

Instead of the push member 40 illustrated in FIGS. 5 to 9, a push member 40, for example, as illustrated in FIGS. 14A to 14D may be provided. FIG. 14A illustrates an example where a second part 42 of a push member 40 has an upper part 43 and a lower part 44 but does not have a side part 45. Since the push member 40 has the upper part 43 and the lower part 44, the push member 40 can hold the uppermost glass slide 10 and the lowermost glass slide 10 with the upper part 43 and the lower part 44 and thus can move the entire stack 90 positively. FIG. 14B illustrates an example where a second part 42 of a push member 40 has a pair of side parts 45 but does not have an upper part 43 and a lower part 44. In the case where the number of stacked glass slides 10 is large, the long sides of the first part 41 extend long in the up-down direction as illustrated in FIGS. 14A to 14D, and a pair of side parts 45 are formed along the long sides. Since the first part 41 is more likely to deflect along the long sides than along the short sides, a pair of side part 45 serves as reinforcement and reduces effectively the extent of bend caused when the push member 40 is pressed.

Figure 14C:
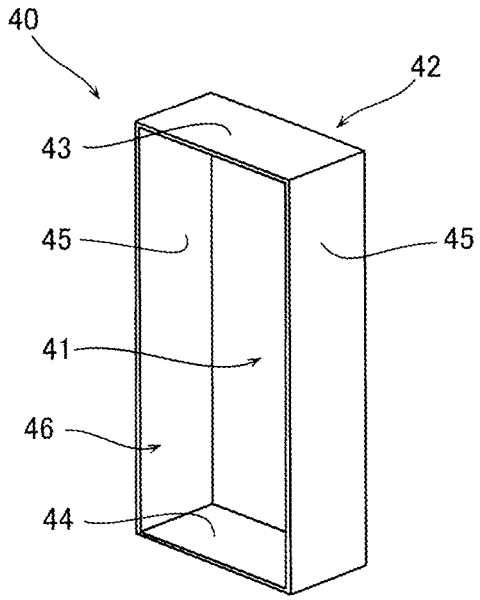
Figure 14D:
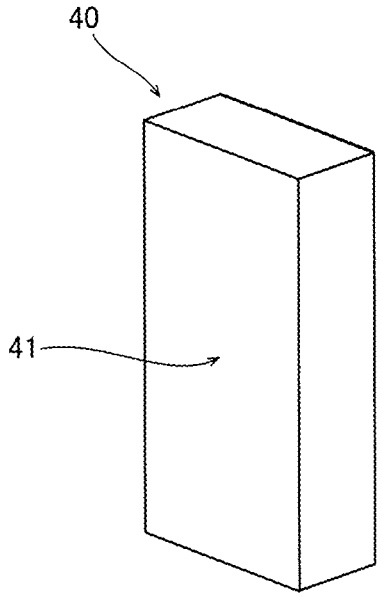

FIG. 14C illustrates an example where slant portions 45*b* are not formed at the distal end side of side parts 45 in the push direction P. The distal ends of the side parts 45 extend almost in parallel with a first part 41 in the up-down direction. The second part 42 provides both the effect of moving the entire stack 90 positively as illustrated in FIG. 14A and the effect of effectively reducing the extent of bend in the push member 40 as illustrated in FIG. 14B. Although an upper part 43, side parts 45, and a lower part 44 may be separate at each borderline, if that parts are connected at each borderline, the rigidity of the push member 40 is improved effectively. FIG. 14D illustrates an example of a push member 40 in a plate shape or a block shape. In other words, in the example in FIG. 14D, the push member 40 has a first part 41 but does not have a second part 42. Even with a push member 40 in a plate shape or a block shape, if the thickness in the push direction P is large enough, it is possible to achieve the same high rigidity as in FIG. 14C. However, the example in FIG. 14D does not have a recessed part 46 and occupies a large extra space in the packaging box 20, so that the shapes in FIGS. 14A to 14C are effective also in terms of space saving.

Note that while the box body 20*a* and the cover member 20*b* are made of paper, the push member 40 may be made of resin having a rigidity higher than paper.

Figure 15:
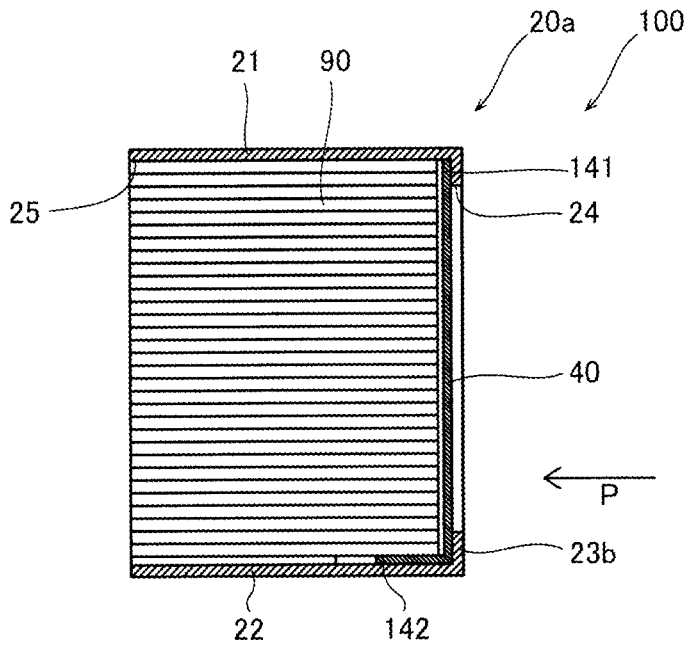
FIG. 15 is a longitudinal sectional view illustrating another configuration example of a push member.
Figure 16:
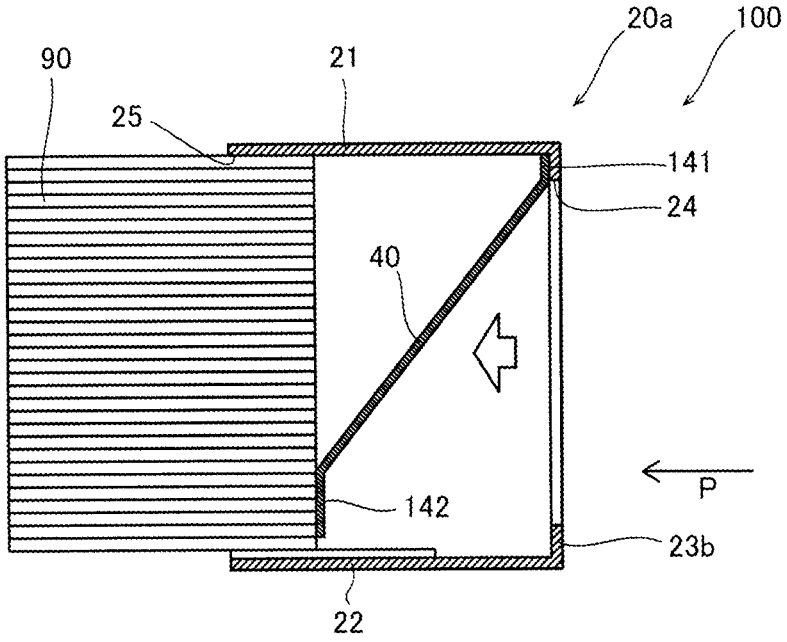
FIG. 16 is a longitudinal sectional diagram illustrating a state where a push member is further pushed in from a state, such as in FIG. 15.

In addition, a push member 40 may be formed integrally with a box body 20*a* or may be movably attached to a box body 20*a* as illustrated in FIGS. 15 and 16. A push member 40 in FIG. 15 has a plate shape, and an upper end portion 141 thereof is attached to the inner surfaces of the upper surface portion 21 and the second side surface portion 23*b*. On the other hand, the lower end portion 142 of the push member 40 is movable inside the box body 20*a*. When the push member 40 is pressed through the push opening 24, the push member 40 rotates on the upper end portion 141 fixed to the inner surface of the box body 20*a* in the push direction P and moves the stack 90 along with the rotation. Since the weight of the glass slides 10 in the stack 90 is concentrated on the lower surface side, portions around the lower end portion 142 of the push member 40 push the lower portion of the stack 90 in the push direction P and move the entire stack 90 in the push direction P with the glass slides 10 remaining stacked. As described above, the push member 40 may be partially fixed as long as the push member 40 is movable inside the box body 20*a* in the push direction P.

Figure 17:
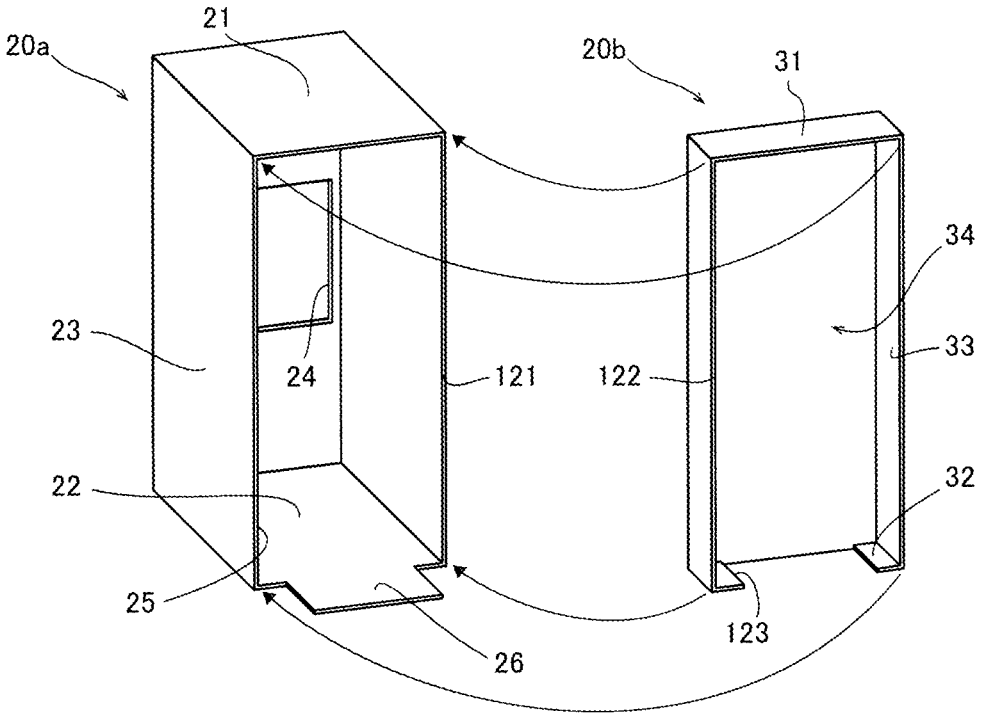
FIG. 17 is an exploded perspective view illustrating a configuration example of a cover member.

In addition, as illustrated in FIG. 17, the cover member 20*b* does not need to be housed inside the box body 20*a*. In the example in FIG. 17, a cover member 20*b* is formed such that the end surfaces of the cover member 20*b* and a box body 20*a* meet each other when the cover member 20*b* faces the box body 20*a*. The end surface 122 of the cover member 20*b* on the opening 34 side and the end surface 121 of the box body 20*a* on the exit opening 25 side meet and come into contact with each other. The cover member 20*b* in FIG. 17 has a cutout 123 at a lower surface portion 32, into which an engagement portion 26 of the box body 20*a* fits. For example, a label or the like is adhered over the box body 20*a* and the cover member 20*b* to fix the box body 20*a* and the cover member 20*b* to each other. Alternatively, a cover member 20*b* may be formed to be larger than a box body 20*a* and the exit opening 25 side of the box body 20*a* may be housed inside the cover member 20*b*.

Figure 18:
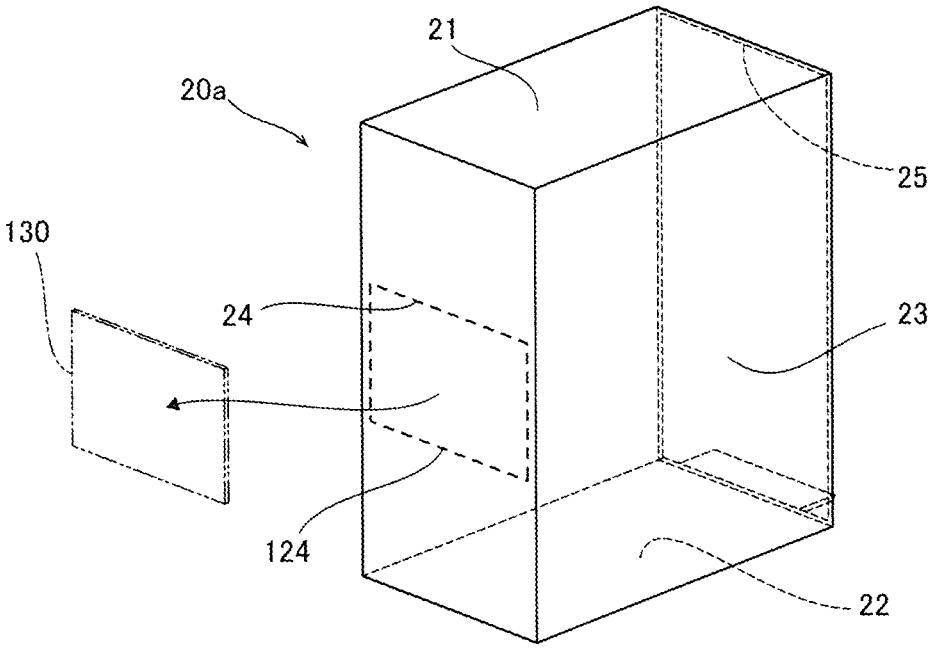
FIG. 18 is a perspective view illustrating an example in which a push opening is closed.

Although FIGS. 5 to 7 illustrate an example where the push opening 24 of the box body 20*a* is open in the initial state, the push opening 24 may be closed at the time when the box body 20*a* is provided to the user. For example, in the case where a box body 20*a* is made of paper, a configuration may be such that the portion of the paper material corresponding to the push opening 24 is not cut out but only perforations 124 are formed as in the example in FIG. 18. A push opening 24 is formed with the perforations 124. When the user removes a closing member 130 (see the chain double-dashed lines) closing the push opening 24 along the perforations 124, the push opening 24 opens.

Meanwhile, a push member 40 does not need to be completely housed inside the box body 20*a* as illustrated in FIGS. 7 and 15 and may be formed integrally with the box body 20*a*. For example, as in the example in FIG. 18, the closing member 130 closing the push opening 24 may function as a push member 40. Specifically, the user does not remove the closing member 130 but pushes in the closing member 130 toward the exit opening 25 and breaks the perforations 124 to separate the closing member 130 from the box body 20*a*. The user may push out the stack 90 via the separated closing member 130 toward the exit opening 25. Similarly, the first cover member 81, illustrated in FIGS. 2A and 2B, for closing the push opening 24 may also function as a push member 40.

Figure 19:
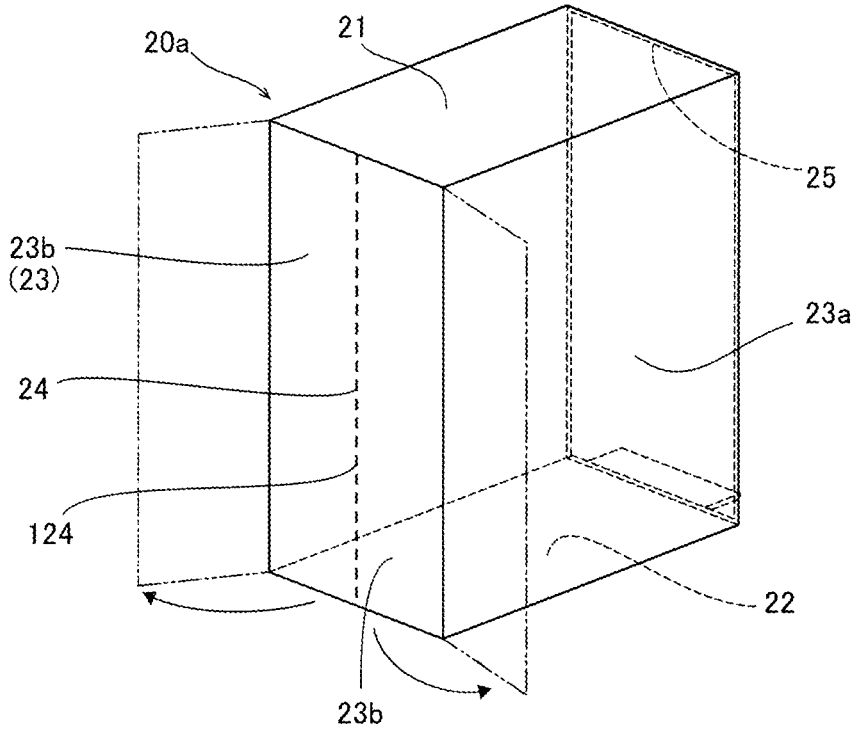
FIG. 19 is a perspective view illustrating another example in which a push opening is closed.

In addition, as illustrated in FIG. 19, a push opening 24 may be formed with perforations 124 at which a side surface portion 23 of the box body 20*a* is to be split. In the case of FIG. 19, the user can split the side surface portion 23 along the perforations 124, open the split side surface portion 23, expose a push member 40 inside the box body 20*a* or a side surface 93 of the stack 90, and push out the stack 90 toward the exit opening 25.

Figure 20:
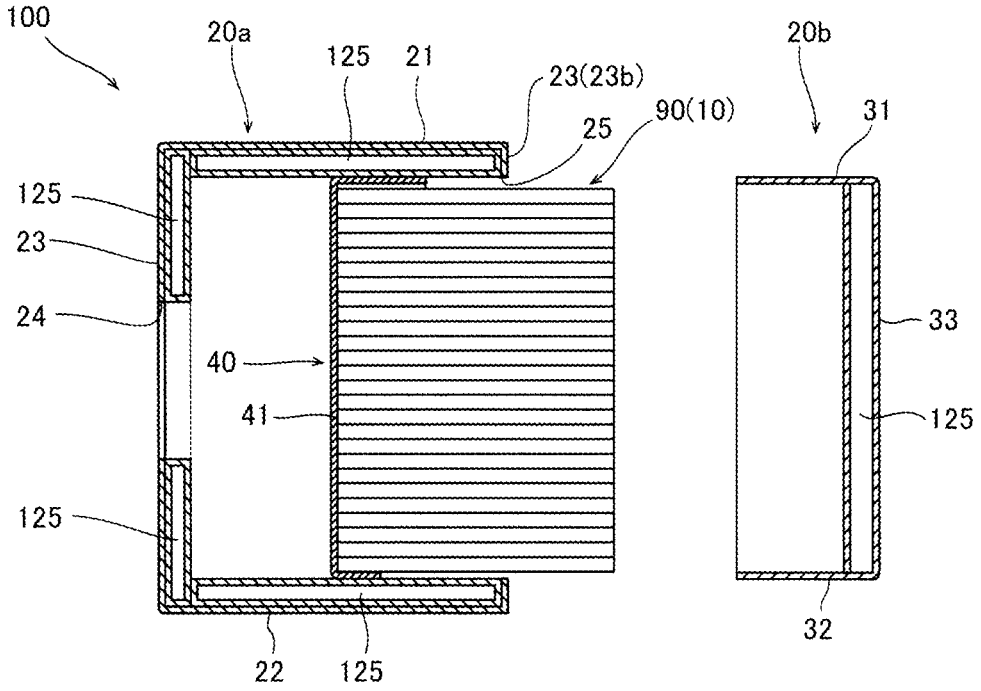
FIG. 20 is a longitudinal sectional view illustrating an example in which spacers are provided in a box body and a cover member.

In addition, as in FIG. 20, spaces or spacers 125 may be formed or provided inside the box body 20*a* and the cover member 20*b* for the purpose of shock absorption. In addition, as in FIG. 20, an exit opening 25 may be formed at a part of the side surface portion 23.

Figure 21A:
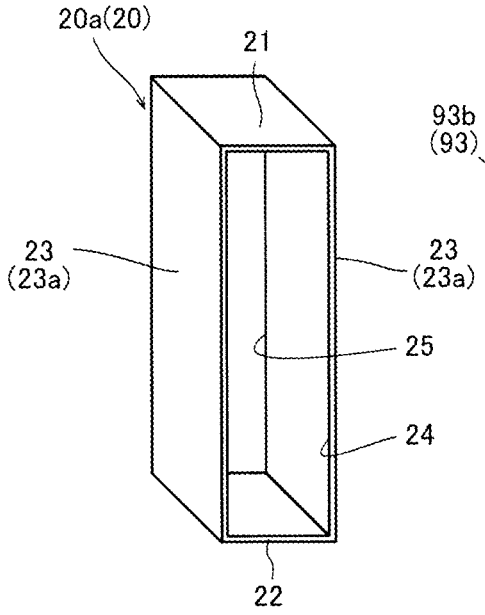
FIGS. 21A and 21B are a perspective view and a longitudinal view, respectively, illustrating another first configuration example of a box body.
Figure 21B:
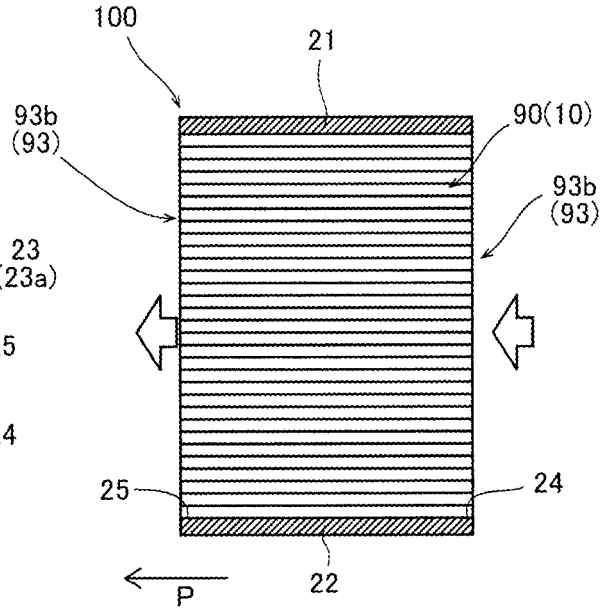

In addition, as in FIGS. 21A and 21B, a box body 20*a* may be formed to be a tube shape having an upper surface portion 21, a lower surface portion 22, and a pair of side surface portions 23 facing each other. In the example in FIGS. 21A and 21B, in the tube-like box body 20*a*, one end opening that is entirely open without a side surface portion 23 is a push opening 24, and the other end opening that is entirely open without a side surface portion 23 is an exit opening 25.

Figure 22A:
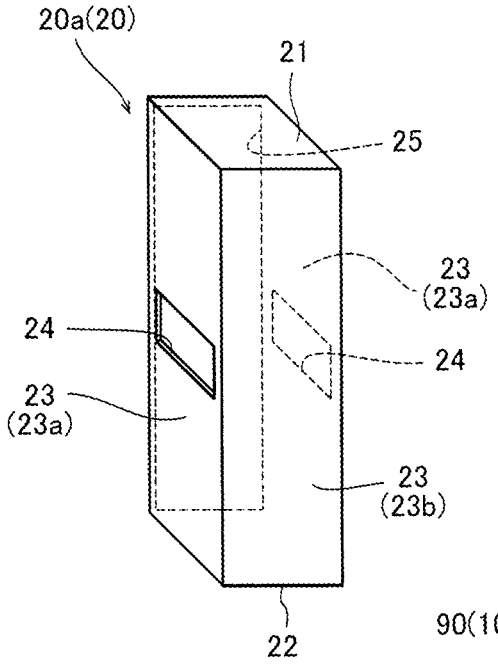
FIGS. 22A and 22B are a perspective view and a longitudinal view, respectively, illustrating another second configuration example of a box body.
Figure 22B:
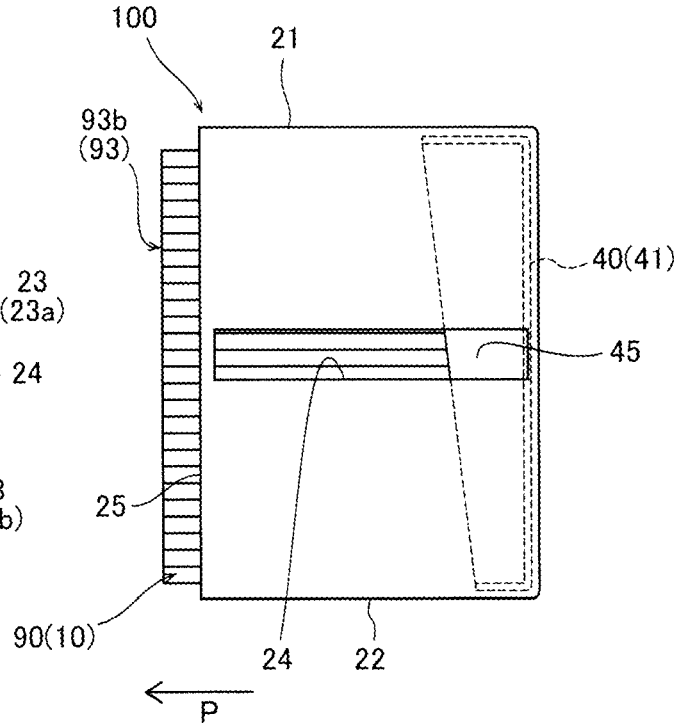

In addition, as in FIGS. 22A and 22B, push openings 24 may be formed on side surface portions 23 that do not face an exit opening 25. The push openings 24 are formed to face the long-side side surfaces 93*a* of the stack 90. In FIGS. 22A and 22B, the exit opening 25 is an opening that is entirely open without one side surface portion 23, whereas the opposite second side surface portion 23*b* is closed and not provided with a push opening 24. A push opening 24 is formed in each of the paired first side surface portions 23*a*. Specifically, the push openings 24 are provided in the first side surface portions 23*a* on the long-side sides, adjacent to the surface provided with the exit opening 25 and formed to extend along the push direction P.

In FIGS. 22A and 22B, the pair of side parts 45 of the push member 40 are exposed to the outside via the push openings 24 in the both side surface portions. The user can hold the pair of side parts 45 from both sides via the push openings 24 of both the side surface portions, push out the stack 90 together with the push member 40 toward the exit opening 25, and take out the stack 90 from the exit opening 25.

Figure 23A:
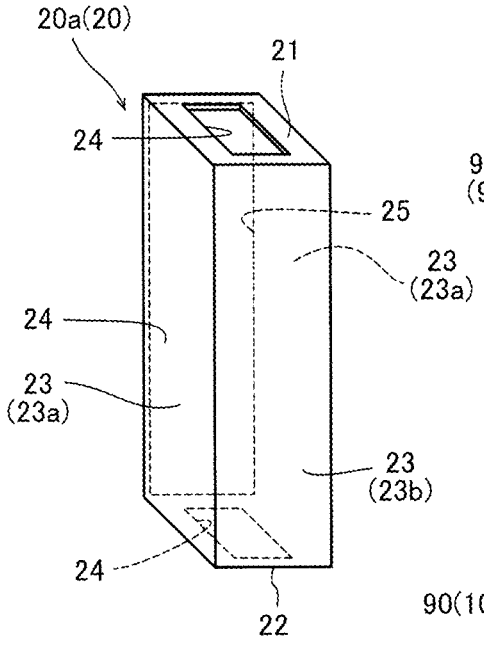
FIGS. 23A and 23B are a perspective view and a longitudinal view, respectively, illustrating another third configuration example of a box body.
Figure 23B:
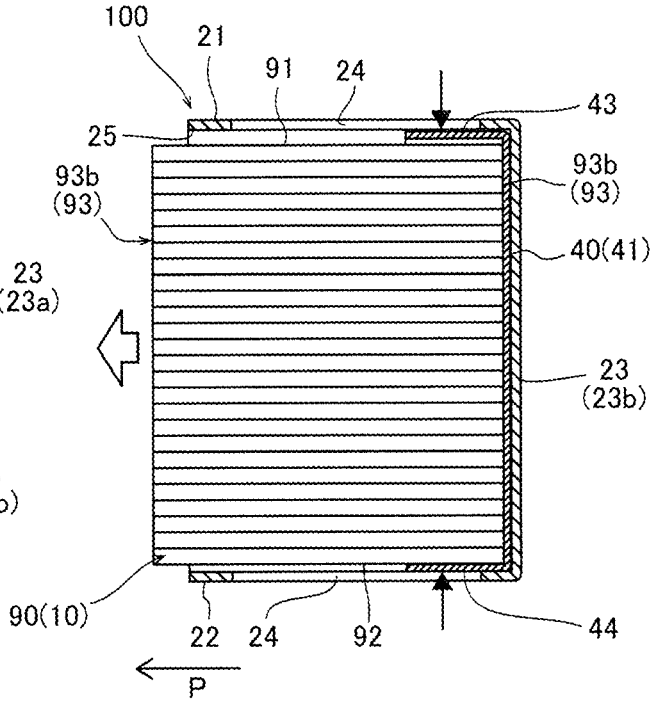

As in FIGS. 23A and 23B, a push opening 24 may be formed in an upper surface portion 21 or a lower surface portion 22, which does not face an exit opening 25. In the example in FIGS. 23A and 23B, a push opening 24 is formed in each of the upper surface portion 21 and the lower surface portion 22. The push openings 24 are provided to face the upper surface 91 and lower surface 92 of the stack 90 and formed to extend along the push direction P.

In FIG. 23B, an upper part 43 and lower part 44 of a push member 40 are exposed to the outside via the push opening 24 in the upper surface portion 21 and the push opening 24 in the lower surface portion 22. The user can hold the upper part 43 and the lower part 44 from both sides in the up-down direction via the push openings 24 of the upper surface portion 21 and the lower surface portion 22, push out the stack 90 together with the push member 40 toward the exit opening 25, and take out the stack 90 from the exit opening 25.

Note that in the case where only one push opening 24 is provided in an upper surface portion 21, a lower surface portion 22, or a side surface portion 23 that does not face an exit opening 25, a part of a second part 42 of a push member 40 may be exposed from the push opening 24, for example, and the outside surface of the exposed second part 42 may have a recess or a protrusion. The user can place his or her fingers on the recess or the protrusion on the outside surface of the exposed second part 42 and push out the push member 40 toward the exit opening 25.

Second Embodiment

Figure 24A:
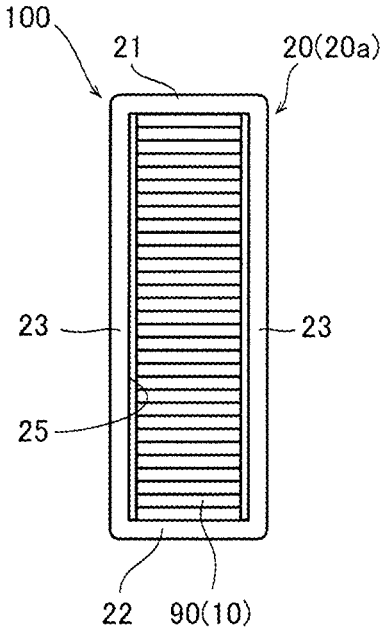
FIGS. 24A and 24B are a side view on an exit opening side and a longitudinal sectional view, respectively, illustrating a packaging box for a glass slide set according to a second embodiment.
Figure 24B:
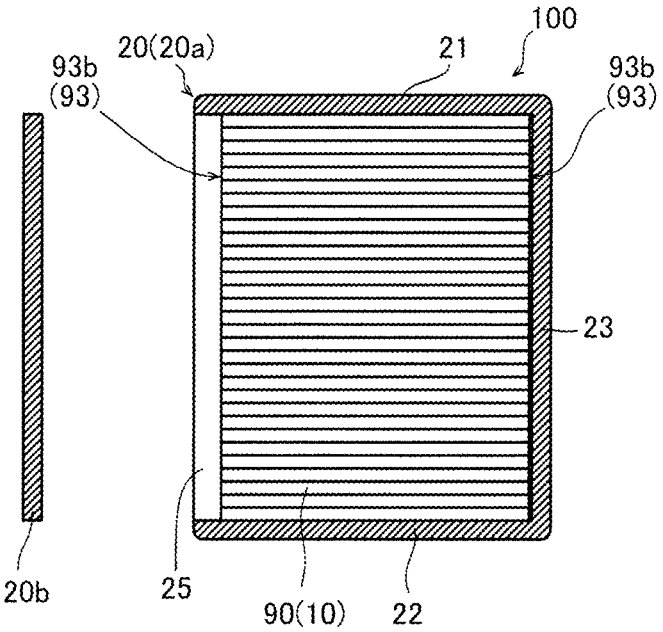
Figure 25:
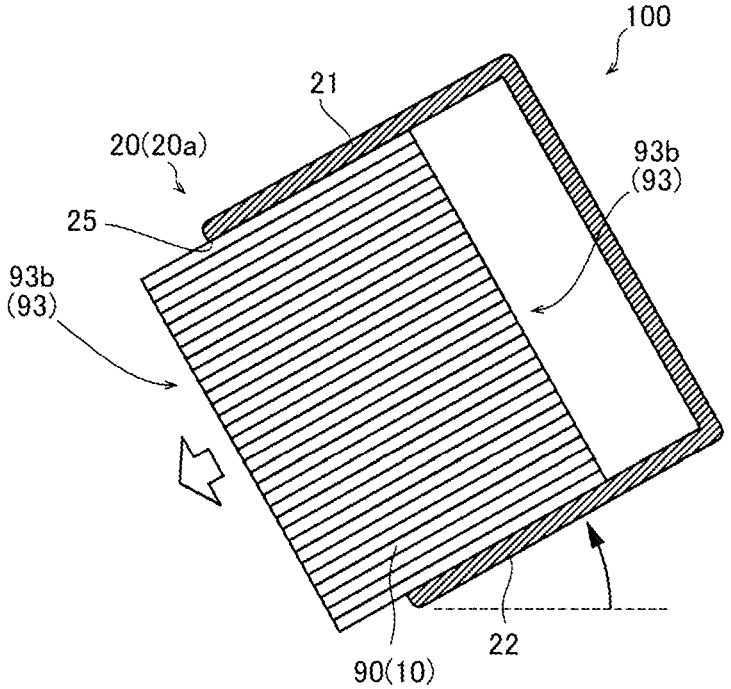
FIG. 25 is a diagram illustrating taking out a stack in a glass slide set, such as in FIGS. 24A and 24B.

Next, with reference to FIGS. 24A, 24B, and 25, description is provided for a second embodiment, which is different from a first embodiment described above. In a second embodiment, unlike a first embodiment above, a packaging box 20 does not need to have a push opening 24. Other items in a second embodiment are the same as those in a first embodiment above.

A glass slide set 100 illustrated in FIGS. 24A and 24B is a glass slide set including a stack 90 of glass slides 10 and a packaging box 20 that houses the stack 90.

In a second embodiment, the packaging box 20 has an exit opening 25 for taking out the stack 90 such that a short-side side surface 93*b* of the stack 90 comes first. In the example in FIG. 24B, the exit opening 25 faces one short-side side surface 93*b* of the stack 90, and the other short-side side surface 93*b* of the stack 90 is covered with a side surface portion 23 of the packaging box 20. In other words, the side surface portion 23 on the opposite side of the stack 90 from the exit opening 25 does not have a push opening 24 illustrated in FIG. 1.

In the example in FIG. 24A, the exit opening 25 has almost the same size as the one short-side side surface 93*b* of the stack 90. Thus, the stack 90 can be directly moved from the exit opening 25. The exit opening 25 may be formed larger than the short-side side surface 93*b*. The inner edge of the exit opening 25 on the lower surface portion 22 side is on the same plane as the inner surface of the lower surface portion 22. The packaging box 20 includes a box body 20*a* which covers at least a part of the upper surface 91, lower surface 92, and side surfaces 93 of the stack 90 and may further include a cover member 20*b* which is a member separate from the box body 20*a* and is for housing the stack 90 from the exit opening 25 side of the box body 20*a*.

In a second embodiment, for example, as in the example illustrated in FIG. 25, when the packaging box 20 is inclined such that the exit opening 25 side is lower, the stack 90 can slide along the lower surface portion 22. The glass slides 10 included in the stack 90 move in the direction along the long sides and are moved through the exit opening 25.

With this configuration, in a second embodiment, the user can move the stack 90 of the glass slides 10 from the inside of the packaging box 20 toward the exit opening 25, for example, by inclining the packaging box 20, and then take out the stack 90 from the exit opening 25. Thus, when the user transfers glass slides 10 from the packaging box 20 to a smear preparing apparatus, the user can transfer the glass slides 10 easily just by sliding the stack 90 toward the exit opening 25 without touching the smear surface 11 of a glass slide 10.

In addition, what needs to be done is only move the stack 90 from the inside of the packaging box 20 in the longitudinal direction. Hence, unlike the case of moving the stack 90 in the lateral direction, the glass slides 10 can be transferred with the stack 90 kept stable, and this also reduces the possibility of dropping the glass slides 10 or exerting an impact on the glass slides 10. In other words, if the stack 90 exits by moving it in the direction along the short sides of the glass slides 10, the stack 90 is unstable because the length of the short sides of common glass slides 10 are small. Moving the stack 90 in the direction along the long sides of the glass slides 10 makes it possible to take out the stack 90 from the exit opening 25 stably.

Even in the case of employing the configuration allowing the user to transfer the stack 90 easily without touching a smear surface 11 just by sliding it toward the exit opening 25, what needs to be done is just to form an exit opening 25 in the packaging box 20, and thus a simple structure can be employed. As described above, it is possible to make the transfer work easy even in the case of transferring glass slides from a simple packaging box.

Third Embodiment

Figure 26:
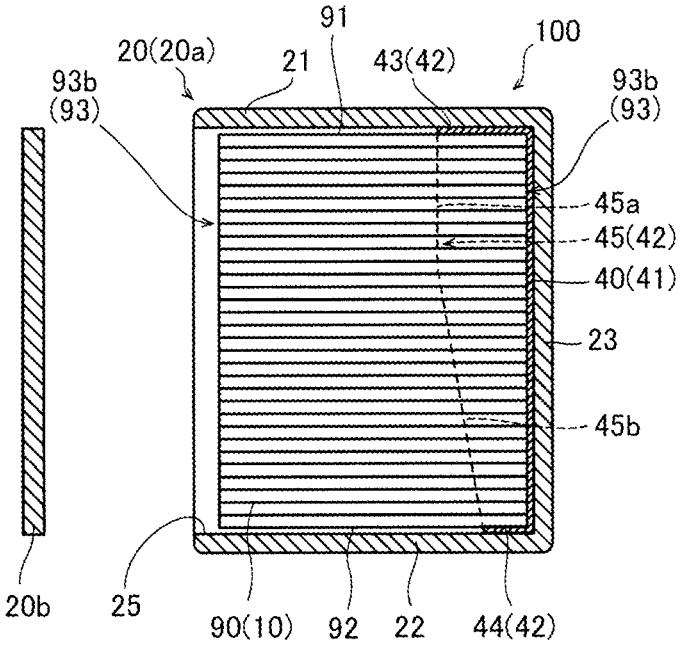
FIG. 26 is a longitudinal sectional view illustrating a glass slide set according to a third embodiment.
Figure 27:
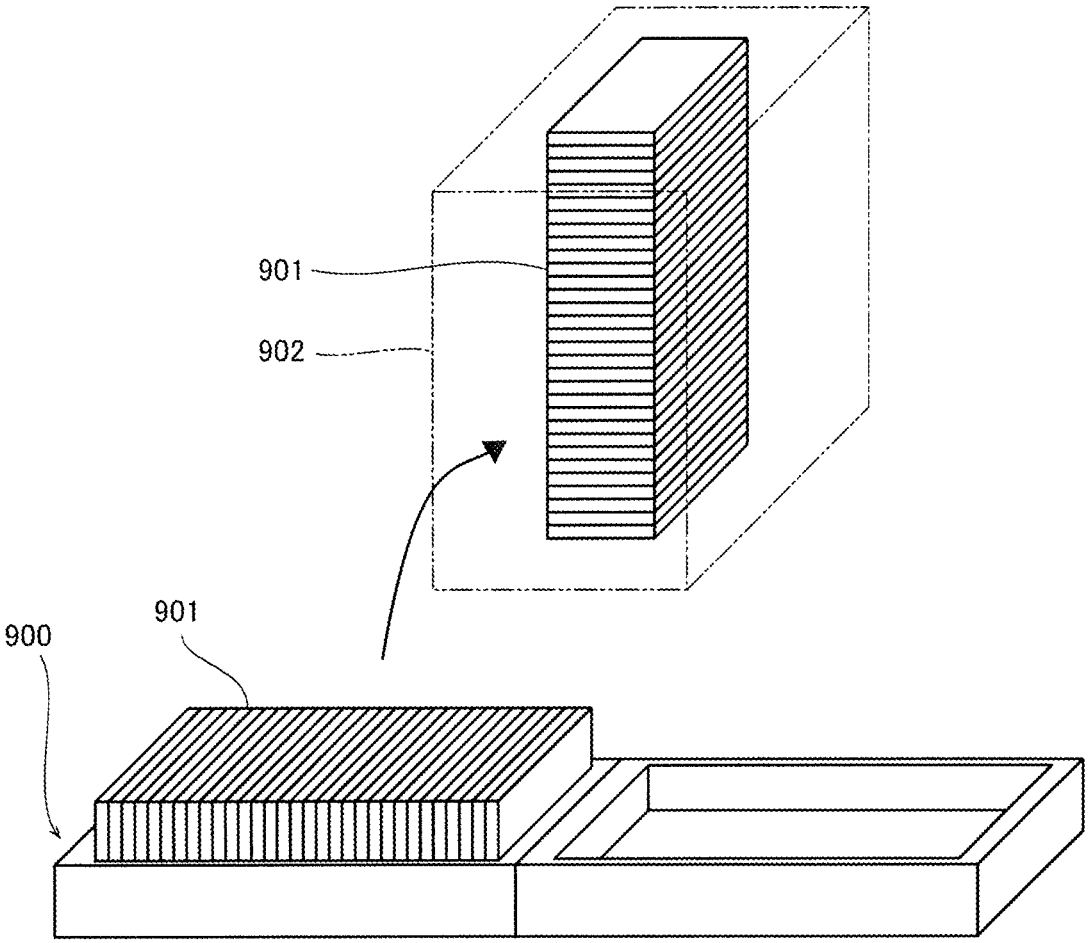
FIG. 27 is a perspective diagram illustrating work to transfer glass slides from a conventional packaging box.

Next, with reference to FIG. 26, description is provided for a third embodiment, which is different from a first embodiment described above. In a third embodiment, a packaging box 20 does not need to have a push opening 24, unlike a first embodiment above. In addition, in a third embodiment, an exit opening 25 does not need to be formed at a position facing a short-side side surface 93*b*, unlike a second embodiment.

As illustrated in FIG. 26, in a third embodiment, a packaging box 20 includes an exit opening 25 for taking out a stack 90 and a push member 40 which is disposed on the opposite side of the stack 90 from the exit opening 25 and capable of moving the stack 90 toward the exit opening 25. Other items in a third embodiment are the same as those in a first embodiment above.

Although detailed illustration is omitted, a box body 20*a* in the example in FIG. 26 includes an upper surface portion 21, a lower surface portion 22, and three side surface portions 23 excluding the side surface where the exit opening 25 is formed. The box body 20*a* does not have a push opening 24. In the example in FIG. 26, the user can move the push member 40 toward the exit opening 25, for example, by pressing the side of the packaging box 20, on which the push member 40 is disposed, from the outside of the packaging box 20 toward the exit opening 25. In other words, in the case of FIG. 26, the user can move the push member 40 via the side surface portion 23 by pressing and recessing the side surface portion 23 toward the exit opening 25. It is possible to move the stack 90 to the exit opening 25 together with the push member 40 by deforming the packaging box 20, like collapsing it, from the side opposite from the exit opening 25 toward the exit opening 25.

With this action, the user can move the stack 90 of the glass slides 10 together with the push member 40 via the push member 40 from the inside of the packaging box 20 toward the exit opening 25 and take out the stack 90 from the exit opening 25. Thus, when the user transfers the glass slides 10 from the packaging box 20 to a smear preparing apparatus, the user can transfer the glass slides 10 easily without touching the smear surface 11 of a glass slide 10. In addition, since there is no need to hold the glass slides 10 with the hands to take them out, but it is possible to send out the glass slides 10 from the inside of the packaging box 20, it is also possible to reduce the possibility of dropping the glass slides 10 or exerting an impact on the glass slides 10 when transferring them. Even in that case, since the packaging box 20 only needs to have the exit opening 25 and the push member 40, a simple structure can be employed for the packaging box 20. As described above, it is possible to make the transfer work easy even in the case of transferring glass slides from a simple packaging box.

Also in a third embodiment, the configurations illustrated in FIG. 9 and FIGS. 14A to 14D can be employed for the push member 40. In the example in FIG. 26, the push member 40 has the shape illustrated in FIG. 9. As illustrated in FIG. 9, the push member 40 includes a first part 41 disposed on the opposite side of the stack 90 from the exit opening 25 and a second part 42 which is connected to the first part 41 and covers at least a part of the upper surface 91, the lower surface 92, or the side surfaces 93 adjacent to the side surface 93 on the first part 41 side, of the stack 90. The second part 42 has an upper part 43 extending along the upper surface 91 of the stack 90 and a lower part 44 extending along the lower surface 92 of the stack 90, and the push member 40 is formed to hold the stack 90 between the upper part 43 and the lower part 44.

The second part 42 has a pair of side parts 45 extending along the pair of side surfaces 93 adjacent to the side surface 93 of the stack 90 on the first part 41 side, and the push member 40 holds the stack 90 between the pair of side parts 45. The end portions of the side parts 45 on the exit opening 25 side are inclined to get closer to the first part 41 as extending toward the lower surface 92 of the stack 90.

In addition, the second part 42 is annularly continuous so as to surround the stack 90 along the upper surface 91, the lower surface 92, and the pair of side surfaces 93*a*, adjacent to the side surface 93*b* on the first part 41 side, of the stack 90, and the stack 90 is placed to fit in a recessed part 46 constituted of the first part 41 and the annular second part 42. The push member 40 is formed in the packaging box 20 so as to cover substantially the entire side surface 93*b* of the stack 90 opposite from the exit opening 25.

Note that although the exit opening 25 is formed at a position facing a short-side side surface 93*b* in the example in FIG. 26, the exit opening 25 may be formed at a position facing a long-side side surface 93*a* as illustrated in FIGS. 3, 4A, and 4B. The exit opening 25 may face the upper surface 91 or the lower surface 92.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A glass slide set comprising:
a stack of glass slides; and
a packaging box that houses the stack, wherein
the packaging box comprises:
an exit opening through which the stack exits;
a push opening through which the stack is pushed, so that the stack exits through the exit opening, and
a push member that is disposed on an opposite side of the stack from the exit opening and capable of moving the housed stack toward the exit opening, the push member having an outer shape larger than the push opening, wherein the stack comprises an upper surface, and a lower surface, and
the push member comprises:
a first part that is disposed on the opposite side of the stack from the exit opening; and
a second part that is connected to the first part and comprises an upper part that covers a part of the upper surface of the stack and a lower part that covers a part of the lower surface of the stack,
the upper part protrudes farther towards the exit opening than the lower part.

2. The glass slide set according to claim 1, wherein
the stack comprises side surfaces, and
the push opening faces a side surface of the stack different from a side surface on the exit opening side.

3. The glass slide set according to claim 1, wherein
the push opening is provided on an opposite side of the stack from the exit opening.

4. The glass slide set according to claim 1, wherein
the stack further comprises a side surface, and
the packaging box comprises a box body that covers at least a part of the upper surface, the lower surface, and the side surface of the stack.

5. The glass slide set according to claim 1, wherein
the stack further comprises a side surface,
the packaging box comprises a box body that covers at least a part of the upper surface, the lower surface, and the side surface of the stack, and
the push member is separate from the box body.

6. The glass slide set according to claim 1, wherein
the upper part extends along the upper surface of the stack; and
the lower part extends along the lower surface of the stack, and
the push member holds the stack between the upper part and the lower part.

7. The glass slide set according to claim 1, wherein
the second part comprises a pair of side parts extending along a pair of the side surfaces adjacent to the side surface of the stack on the first part side, and
the push member holds the stack between the pair of side parts.

8. The glass slide set according to claim 7, wherein
end portions of the pair of side parts on the exit opening side are inclined to get closer to the first part as extending toward the lower surface of the stack.

9. The glass slide set according to claim 1, wherein
the second part is annularly continuous so as to surround the stack along the upper surface, the lower surface, a pair of side surfaces adjacent to the side surface on the first part side, of the stack, and
the stack is placed to fit in a recessed part formed of the first part and the second part.

10. The glass slide set according to claim 1, wherein
the stack further comprises side surfaces,
the packaging box comprises a box body that covers at least a part of the upper surface, the lower surface, and the side surfaces of the stack, and
the push member covers, inside the box body, substantially a whole of a side surface of the stack on the opposite side from the exit opening.

11. The glass slide set according to claim 1, wherein
the stack comprises a pair of short-side side surfaces, and
the push opening faces one of the pair of short-side side surfaces of the stack.

12. The glass slide set according to claim 11, wherein
the stack further comprises a pair of long-side side surfaces, and the pair of short-side side surfaces,
the packaging box comprises a box body that covers at least a part of the upper surface, the lower surface, and the side surfaces of the stack,
a side surface portion of the box body faces the pair of long-side side surfaces and the one of the pair of short-side side surfaces, and
the exit opening faces the other of the pair of short-side side surfaces.

13. The glass slide set according to claim 1, wherein
the stack further comprises a side surface,
the packaging box comprises a box body that covers at least a part of the upper surface, the lower surface, and the side surface of the stack, and
the box body comprises an engagement portion protruding from an end of the box body on the exit opening side and configured to be engaged with a glass slide setting part of a smear preparing apparatus.

14. The glass slide set according to claim 13, wherein
the engagement portion is formed at a lower surface portion of the box body or between the lower surface portion and the stack and has a plate shape extending along the lower surface of the stack.

15. The glass slide set according to claim 1, wherein
the exit opening is substantially as large as a side surface of the stack on the exit opening side.

16. The glass slide set according to claim 1, wherein
in a stacking direction of the stack, a width of the push opening is smaller than a width of a side surface of the stack on the push opening side.

17. A method of setting glass slides of a glass set according to claim 1, comprising:

placing the exit opening, which is formed in the packaging box that houses the stack of glass slides, so as to face a glass slide setting part of a smear preparing apparatus;

pushing the stack in the packaging box through the push opening that faces a surface of the stack different from a surface of the stack that the exit opening faces; and moving the pushed stack from the packaging box to the glass slide setting part through the exit opening.

* * * * *